US012653277B2

(12) United States Patent
Chaney et al.

(10) Patent No.: US 12,653,277 B2
(45) Date of Patent: Jun. 16, 2026

(54) OVERSHOE FOOTWEAR TRACTION DEVICE

(71) Applicant: OT Intellectual Property, LLC, Portland, OR (US)

(72) Inventors: Brian Chaney, Portland, OR (US); Matthew Martin, Portland, OR (US); Brian O'Boyle, Portland, OR (US)

(73) Assignee: OT Intellectual Property, LLC, Portland, OR (US)

( * ) Notice: Subject to any disclaimer, the term of this patent is extended or adjusted under 35 U.S.C. 154(b) by 914 days.

(21) Appl. No.: 17/367,363

(22) Filed: Jul. 3, 2021

(65) Prior Publication Data

US 2021/0330037 A1 Oct. 28, 2021

Related U.S. Application Data

(62) Division of application No. 15/186,074, filed on Jun. 17, 2016, now Pat. No. 11,051,588.

(Continued)

(51) Int. Cl.
*A43C 15/02* (2006.01)
*A43B 3/16* (2022.01)

(Continued)

(52) U.S. Cl.
CPC ..... *A43C 15/02* (2013.01); *A43B 3/16* (2013.01); *A43B 3/18* (2013.01); *A43B 3/20* (2013.01);

(Continued)

(58) Field of Classification Search
CPC ..... A43C 11/165; A43C 15/02; A43B 7/14; A43B 3/20; A43B 3/18

(Continued)

(56) References Cited

U.S. PATENT DOCUMENTS 230,759 A 8/1880 Drummond
908,704 A 1/1909 Sprinkle (Continued)

FOREIGN PATENT DOCUMENTS

EP 2382887 A2 11/2011
WO 2016205667 A1 12/2016

OTHER PUBLICATIONS

International Search Report and Written Opinion for PCT Application No. PCT/US2016/038105, mailed Oct. 20, 2016, 8 pages.

(Continued)

*Primary Examiner* — Alissa J Tompkins
*Assistant Examiner* — Catherine M Ferreira
(74) *Attorney, Agent, or Firm* — Ganz Law, PC

(57) ABSTRACT

A footwear traction device is provided that is removably attachable to an item of footwear. The footwear traction device comprises a traction portion having one or more traction elements on a bottom thereof, a heel support portion disposed at a rear traction portion, and a forefoot support portion disposed at a forefoot traction portion. A cable extends through cable guides or channels and attaches the traction portion, the heel support portion, and the forefoot support portion together. A cable reel device is rotatably operable to adjust a length of the cable to selectively secure and unsecure the footwear traction device to the item of footwear. Shortening the length of the cable tightens the traction portion, the heel support portion and the forefoot support portion inwardly against the item of footwear, thereby securing the footwear traction device to the footwear.

16 Claims, 24 Drawing Sheets

Related U.S. Application Data

(60) Provisional application No. 62/181,054, filed on Jun. 17, 2015.

(51) Int. Cl.

| | |
|---|---|
| ***A43B 3/18*** | (2022.01) |
| ***A43B 3/20*** | (2022.01) |
| ***A43B 7/14*** | (2022.01) |
| ***A43C 11/00*** | (2006.01) |
| ***A43C 11/16*** | (2006.01) |
| ***A43C 15/04*** | (2006.01) |
| ***A43C 15/06*** | (2006.01) |

(52) U.S. Cl.
CPC ..... *A43B 7/14* (2013.01); *A43C 11/008* (2013.01); *A43C 11/165* (2013.01); *A43C 15/04* (2013.01); *A43C 15/06* (2013.01); *A43C 15/061* (2013.01)

(58) Field of Classification Search
USPC ..... 36/62
See application file for complete search history.

(56) References Cited

U.S. PATENT DOCUMENTS 1,060,422 A 4/1913 Bowdish
2,070,093 A * 2/1937 Roe ..... A43C 15/06 36/7.6
3,019,533 A * 2/1962 Smith ..... A43B 5/18 36/7.6
4,299,037 A 11/1981 Carey
4,353,172 A 10/1982 Bryant
5,425,185 A 6/1995 Gansler
5,463,822 A 11/1995 Miller
5,533,277 A 7/1996 Bell et al.
5,659,978 A 8/1997 Bell et al.
5,689,901 A 11/1997 Bell et al.
5,732,482 A 3/1998 Remington
5,791,068 A 8/1998 Bernier et al.
5,950,334 A 9/1999 Gerhardt
6,052,921 A 4/2000 Oreck
6,088,936 A * 7/2000 Bahl ..... A43C 1/00 36/89
6,754,983 B2 6/2004 Hatfield
6,922,917 B2 8/2005 Kerns et al.
7,370,440 B1 5/2008 Cole, III
7,703,218 B2 4/2010 Burgess
8,201,346 B2 6/2012 Darby et al.
8,250,779 B2 8/2012 Bell et al.
8,424,168 B2 4/2013 Soderberg
8,434,200 B2 5/2013 Chen
8,468,657 B2 * 6/2013 Soderberg ..... A43C 11/165 242/395
D838,463 S 1/2019 Durflinger
D843,099 S 3/2019 Bunch
D854,303 S 7/2019 Flanagan et al.
D909,740 S 2/2021 Kanata
D911,016 S 2/2021 Richez et al.
D911,697 S 3/2021 Sallee
2001/0025434 A1 10/2001 Fellouhe
2002/0095820 A1 7/2002 Giovale
2003/0000107 A1 1/2003 Blackburn
2004/0045190 A1 3/2004 Washburn et al.
2004/0226151 A1 11/2004 St-Louis et al.
2004/0226190 A1 11/2004 Elkington et al.
2005/0022427 A1 2/2005 Kerns et al.
2005/0081403 A1 4/2005 Mathieu
2005/0193596 A1 9/2005 Culton
2005/0229428 A1 10/2005 Holcomb
2006/0000116 A1 * 1/2006 Brewer ..... A43C 1/04 36/11.5
2006/0080861 A1 4/2006 Park et al.
2006/0117598 A1 6/2006 Czaplewski et al.
2007/0011910 A1 1/2007 Keen
2007/0056187 A1 * 3/2007 Burgess ..... A43C 15/06 36/7.5
2007/0068040 A1 3/2007 Farys
2007/0175064 A1 8/2007 Culton
2008/0000102 A1 1/2008 Rastegar
2008/0000103 A1 1/2008 Rastegar
2008/0000104 A1 1/2008 Rastegar et al.
2008/0052957 A1 3/2008 Taheri
2008/0060167 A1 3/2008 Hammerslag et al.
2008/0066346 A1 3/2008 Hammerslag
2008/0172848 A1 7/2008 Chen
2008/0184591 A1 8/2008 Chang
2008/0189987 A1 8/2008 Geisser et al.
2009/0025253 A1 1/2009 Harper et al.
2009/0199435 A1 8/2009 Robinson et al.
2010/0146683 A1 6/2010 Laniado
2010/0257750 A1 10/2010 Bell et al.
2010/0319216 A1 12/2010 Grenzke et al.
2011/0047829 A1 * 3/2011 Bell ..... A43C 15/161 36/62
2011/0056095 A1 3/2011 Torrance
2011/0099847 A1 * 5/2011 Koe-Krompecher ..... A43C 15/16 36/15
2011/0225843 A1 9/2011 Kerns et al.
2011/0258876 A1 10/2011 Baker et al.
2011/0258878 A1 * 10/2011 Jones ..... A43C 15/066 36/62
2012/0240428 A1 * 9/2012 Knoll ..... A43B 5/0427 36/50.1
2012/0266491 A1 * 10/2012 May ..... A43C 13/08 36/62
2013/0014409 A1 1/2013 Chouinard
2013/0092780 A1 4/2013 Soderberg
2013/0138028 A1 5/2013 Gerber
2013/0138029 A1 5/2013 Gerber
2013/0180130 A1 7/2013 Giovale
2013/0263477 A1 10/2013 Girard
2013/0305565 A1 11/2013 Jones
2014/0020263 A1 1/2014 Theuvenet et al.
2014/0157627 A1 6/2014 Smaldone et al.
2014/0196312 A1 7/2014 Sakaue
2014/0208550 A1 7/2014 Neiley et al.
2014/0259783 A1 9/2014 Dinndorf et al.
2014/0290016 A1 10/2014 Lovett
2014/0338223 A1 11/2014 Adams et al.
2015/0007422 A1 1/2015 Cavanagh
2015/0059206 A1 3/2015 Lovett et al.
2015/0076272 A1 3/2015 Trudel et al.
2015/0096202 A1 4/2015 Hahnenberger et al.

OTHER PUBLICATIONS

Office Action in Canadian Application No. 2988142, mailed Oct. 1, 2018, 7 pages.
Non-Final Office Action in U.S. Appl. No. 15/186,047, mailed Sep. 23, 2019, 18 pages.
Final Office Action in U.S. Appl. No. 15/186,047, mailed Dec. 29, 2020, 13 pages.
Non-Final Office Action in Design U.S. Appl. No. 29/631,134, mailed Mar. 19, 2020, 10 pages.
Final Office Action in Design U.S. Appl. No. 29/631,134, mailed Jan. 4, 2021, 7 pages.
Notice of Allowance for Design U.S. Appl. No. 29/631,134, mailed Apr. 28, 2021, 6 pages.

* cited by examiner

OVERSHOE FOOTWEAR TRACTION DEVICE

CROSS-REFERENCE

The present application claims the benefit of and priority to U.S. application Ser. No. 15/186,074, filed Jun. 17, 2016, issued Jul. 6, 2021 as U.S. Pat. No. 11,051,588, which claims benefit of and priority of U.S. provisional patent application No. 62/181,054, filed Jun. 17, 2015, the entirety of which is hereby incorporated by reference.

FIELD OF INVENTION

The present invention relates to footwear traction devices that are removably attachable to an item of footwear.

BACKGROUND

Slips and falls are one of the most common cause of injuries and fatalities in the general community in the workplace. Slips and falls are also a problem during recreational activities. Slips are primarily caused by slippery ground or floor surface conditions which can generally be attributed to buildup of moisture such as rain, sleet, hail, snow, ice, or spilled contaminants such as oils and greases.

Footwear traction devices or overshoe safety products are designed to increase the coefficient of friction between the ground and the device, ultimately improving traction. Previously implemented footwear traction devices use a variety of soft rubber compounds and piercing objects, such as spikes or studs on a bottom tread surface, to increase the coefficient of friction or enhance traction. Because these footwear traction devices are generically designed to fit over a wide variety of shoe and boot shapes and sizes, the fit, security, durability, and ease-of-use of the footwear traction devices may be compromised. The previously-implemented footwear traction devices may break, malfunction, or fail while in use, further increasing the risk of a slip or fall injury. These shortcomings are especially problematic in rugged terrain, harsh conditions, or when used in strenuous or athletic activities where stress on the footwear traction device is increased.

Further, attachment and detachment of previously-implemented footwear traction devices to and from footwear may be cumbersome and require physical strength to pull and stretch an elastic material comprising the footwear traction devices over the footwear, which often dissuades people from wearing or purchasing these footwear safety products. These designs may be particularly unwieldy or hazardous for those who are elderly, suffer from injury, or have weight, flexibility, or strength issues.

DETAILED DESCRIPTION

Figure 1A:
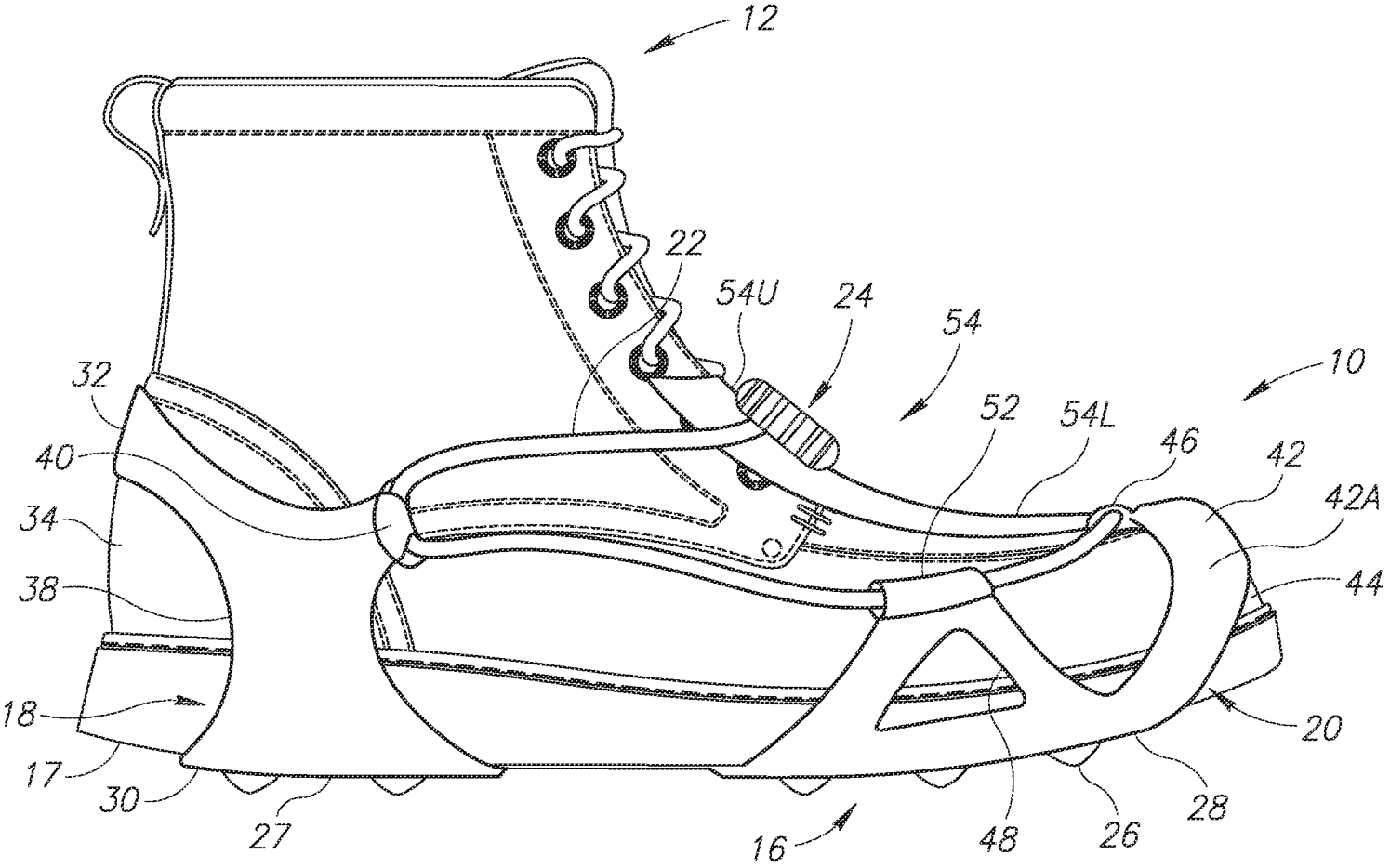
FIG. 1A illustrates a lateral side elevational view of a footwear traction device according to a first embodiment.
Figure 1B:
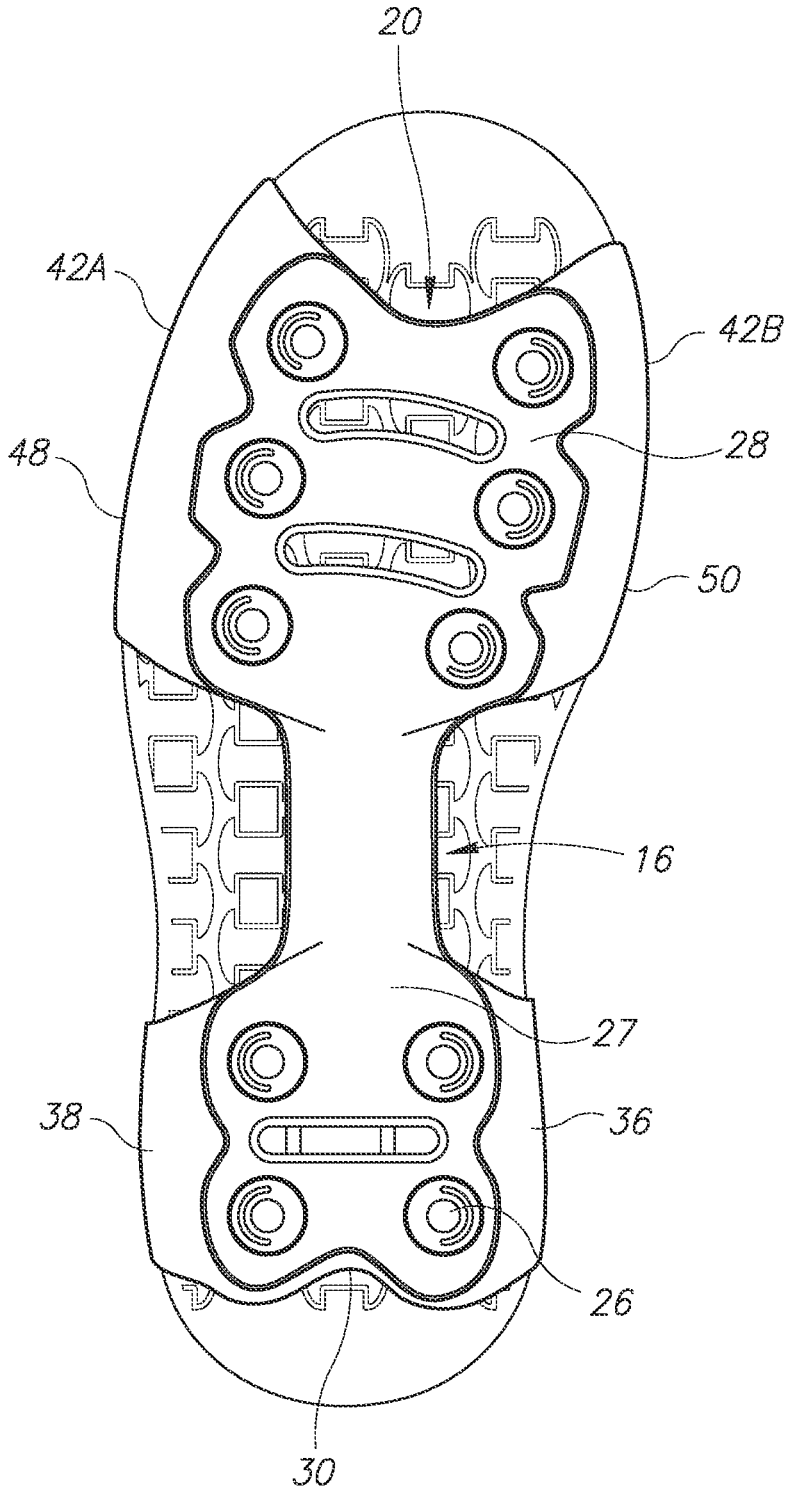
FIG. 1B illustrates a bottom plan view of the footwear traction device of FIG. 1A.
Figure 1C:
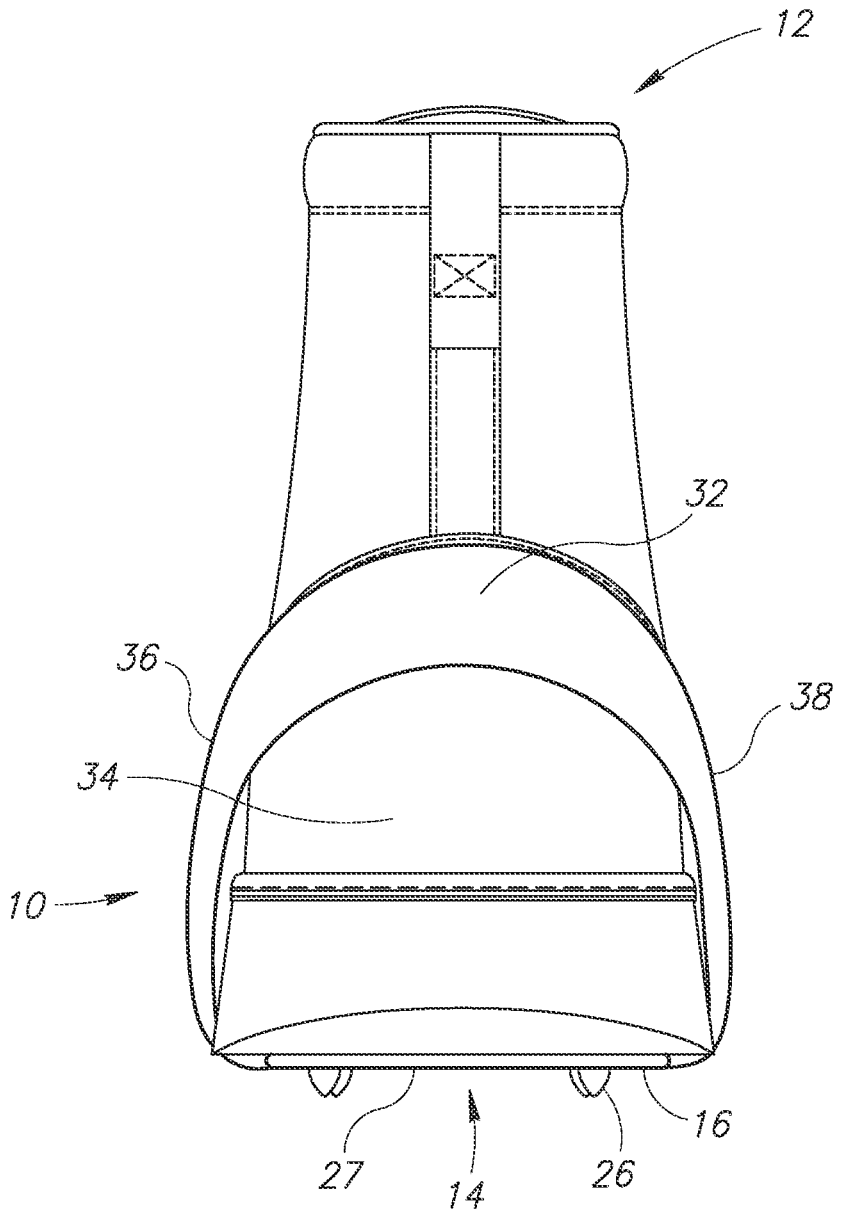
FIG. 1C illustrates a rear elevational view of the footwear traction device of FIG. 1A.

A first embodiment of a footwear traction device 10 removably attachable to an item of footwear 12 is shown in FIGS. 1A, 1B, and 1C. The footwear traction device 10 includes a traction member 14 having a support body 16 at least partially covering a bottom outer sole 17 of the item of footwear 12, a heel support portion 18 positioned at a rear end of the support body for attaching to a rear portion of the item of footwear at or around a heel, and a forefoot support portion 20 positioned at a forward end of the support body for attaching to a front portion of the item of footwear at or around the forefoot. A length of cable 22 extends from a cable reel device 24, extends between and attaches the heel support portion 18 and the forefoot support portion 20 together, and extends back to the cable reel device. The cable reel device 24 is rotatably operable to adjust the length of the cable 22 to selectively secure and unsecure the footwear traction device 10 to the item of footwear 12. Increasing the length of cable 22 allows the footwear to be easily inserted into and removed from the footwear traction device 10.

The support body 16 of the traction member 14 has an elongated, substantially flat shape that at least partially covers the bottom outer sole 17 when the footwear traction device 10 is attached to the footwear 12. The traction member 14 may include a plurality of traction elements 26 protruding downwardly from a bottom surface 27 of the support body 16 for increasing friction between the footwear 12 and the ground. The traction elements 26 may be comprised of a rigid, durable material, such as steel or aluminum, adapted to bite into hard snow or ice. The traction elements 26 may be arranged on a front body portion 28 of the support body 16 below the forefoot support portion 20, and/or may be arranged on a rear body portion 30 below the heel support portion 18. In some embodiments, the bottom surface 27 of the heel support body 18 may have a rough texture and/or ridged portions for increasing friction. The support body 16 may be comprised of a flexible material with a high durometer, such as silicone rubber, that flexes or bends to conform to the bottom outer sole 17. In the present embodiment, the support body 16 is a single, unitary member having a length extending from the heel support portion 18 to the forefoot support portion 20. However, in some embodiments, the support body 16 may comprise two or more separate members, with one member positioned below the heel support portion 18 and a second member positioned below the forefoot support member 20.

The heel support portion 18 and/or the forefoot support portion 20 may comprise a flexible frame or frame-like structure adapted to bend, flex or stretch to receive the footwear 12 when inserted into the footwear traction device 10. The heel support portion 18 and the forefoot support portion 20 may comprise a flexible or elastic material, such as rubber, silicone, or a textile material.

The heel support portion 18 has a rear support 32 that extends along and at least partially covers a rearwardly facing heel portion 34 of the footwear 12 when the footwear traction device 10 is attached thereto or inserted therein, as shown in FIG. 1C. A rear medial sidewall 36 extends upwardly from a medial side of the heel support portion 18 of the support body 16, and a rear lateral sidewall 38 extends upwardly from a lateral side of the heel support portion opposite to the medial side. The rear medial sidewall 36 has a substantially similar shape to the rear lateral sidewall 38 so further illustration thereof is omitted. The rear medial sidewall 36 and/or the rear lateral sidewall 38 may each have an attachment portion 40 provided with a cable channel or guide for slidably receiving the cable 22 and attaching the cable to the heel support portion 18. The cable guides or channels described herein may comprise an enclosed tubular structure or an open curved or U-shaped structure for guiding a length of cable along a path. The cable guide or channel may help to maintain the length of cable at a position relative to another part or in a desired orientation. The cable guides and attachment portions protect the cable 22 from snagging, cutting, or ablating. The attachment portion 40 is disposed on the rear medial sidewall 36 in a manner substantially similar to the rear lateral sidewall shown in FIG. 1A, so further illustration thereof is omitted. The rear support 32 extends between and connects the rear medial sidewall 36 and the rear lateral sidewall 38 along the heel portion 34 above a rear end of the support body 16. The rear support 32 is a strap or band extending over a portion of the heel portion 34 in the present embodiment, but may instead be a thicker support that extends upwardly from the support body 16 covering all or a majority of the heel portion.

A front support 42 of the forefoot support portion 20 extends upwardly and forwardly from the front body portion 28 and at least partially covers a front 44 of the footwear 12 at or around the toe cap. The front support 42 of the present embodiment includes a lateral front support portion 42A extending upwardly from a lateral side of the support body 16 and a medial front support portion 42B substantially similar to the lateral front support portion extending upwardly from a medial side of the support body opposite to the lateral side. The lateral front support portion 42A and the medial front support portion 42B may arc upwardly and join with each other at or above the toe cap exposing the front 44 of the footwear 12. Alternatively, the front support 42 may have a single support portion extending upwardly from the front body portion 28 of the support body 16. The front support 42 may have a pocket or cup in the front for enclosing the toe box or toe cap of the footwear 12 when the footwear traction device 10 is secured thereto. One or more attachment portions 46 are disposed at or near an upper end of the front support 42. The attachment portion 46 has a cable channel or guide for receiving the cable 22 and attaching the cable to the forefoot support portion 20.

The forefoot support portion 20 may include a lateral support 48 extending upwardly from the lateral side of the support body 16 and wrapping around a lateral front side of the footwear 12 at or near a lateral metatarsal foot region when the footwear attachment apparatus 10 is attached to the footwear. The forefoot support portion may include a medial support 50 extending upwardly from the medial side of the support body opposite to the lateral support 48 and wrapping around a medial side of the footwear 12 at or near a medial metatarsal foot region when the footwear attachment apparatus 10 is attached to the footwear. The lateral support 48 and the medial support 50 may each have an attachment portion 52 respectively disposed at an upper end thereof provided with a cable channel or guide described above.

The footwear traction device 10 may include an upper support portion 54 that extends upwardly and inwardly from the front support 42 of the forefoot support portion 20. The upper support portion 54 may be a flexible member having a lower portion 54L attached to the front support 42. The lower portion 54L may be part of the forefoot support portion 20 or be attached directly thereto by sewing or use of adhesives. Alternatively, the cable 22 may extend through a cable guide of an attachment portion on the lower portion 54L to attach the upper support portion 54 to the forefoot support portion 20. The upper support portion 54 may have an elongated shape extending upwardly from the front support 42 at or near the attachment portion 46 and terminating at an upper portion 54U. When the footwear traction device 10 is attached to the footwear 12, the elongated shape of the upper support portion 54 may extend upwardly along the front side of the footwear over or against the tongue or shoelaces. In the present embodiment, the cable reel device 24 is fixedly attached to an outwardly facing surface at or near the upper portion 54U of the upper support portion 54; however, other attachment locations for the cable reel device 24 are contemplated. For example, the cable reel device 24 may be attached to the rear support 32 or rear sidewalls 36 or 38.

The cable reel device 24 is a reel based closure device having a rotatable mechanism operable to selectively lengthen and shorten the length of the portion of the cable 22 extending through the attachment portions of the footwear traction device 10, and adjust the tension of the cable. Specifically, rotation of the cable reel device 24 in a first rotational direction (e.g., clockwise) lengthens the cable 22 and rotation of the cable reel device in a second rotational direction (e.g., counterclockwise) opposite to the first rotational direction shortens the length of the cable. The cable reel device 24 may comprise a knob rotatable to wind and unwind the cable 22 about a spool and thereby adjust the length. In some embodiments, the knob may be moved between an inward position allowing rotation of the cable reel device 24 in the second direction and preventing rotation thereof in the first direction, and an outward "quick-release" position releasing tension in the cable 22 and allowing the length of the cable to be freely lengthened. The cable reel device 24 may be a Boa® Technology closure system, for example. In some embodiments, first and second ends of the cable 22 are fixedly attached within the cable reel device 24; however, the first and second ends may be fixedly attached elsewhere, such as receptacles or attachment portions in the forefoot support portion 20 or the heel support portion 18 by way of non-limiting example.

The length of the cable 22 extends from the cable reel device 24 through each of the attachment portions of the footwear traction device 10. Specifically, the cable 22 extends rearwardly from the cable reel device 24, downwardly through the cable guide 9 of the attachment portion 40 of the heel support portion 18, and then forwardly through the attachment portion 52 of the front lateral support 48. The cable 22 wraps around the front of the footwear 12, through the cable guide of the attachment portion 46, and over to the medial side of the footwear 12. The cable 22 may extend through the cable guide or member of the upper support portion 54 attaching it at the front of the forefoot support portion 20. On the medial side of the footwear traction device 10, the cable 22 then passes through the cable guide of the attachment portion 52 of the front medial support 50, extends upwardly through the attachment portion 40 of the rear medial sidewall 36, and then forwardly back into the cable reel device 24.

The cable reel device 24 is operable as described above to adjust the length of the cable 22 to selectively secure and unsecure the footwear 12 positioned within the footwear traction device 10. The length of the cable 22 may be adjusted to allow the footwear 12 to be inserted between the rear support 32 and an inwardly facing surface of the upper support portion 54. The footwear 12 may be positioned such that the front 44 thereof is against the front support 42 and the bottom outer sole 17 is against an upper surface of the support body 16. Thereafter, the cable reel device 24 may be rotated in the second direction to shorten the length of the cable 22 and increase the tension in the cable until the footwear 12 is secured within footwear traction device 10.

As the cable reel device 24 is rotated in the second direction, tension on the cable 22 increases and the cable pulls the attachment portions inwardly and tightens the footwear traction device 10 against the footwear 12. In particular, shortening the cable 22 pulls the attachment portion 40 inwardly and forwardly thereby tightening the heel support portion 18 and the rear support 32 inwardly against the back of the heel portion 34, respectively tightening the rear medial sidewall 36 and the rear lateral sidewall 38 inwardly against rear medial and rear lateral portions of the footwear 12 and tightening the rear body portion of the support body 16 upwardly against the bottom outer sole 17. Simultaneously, the cable 22 pulls the attachment portions 46 of the forefoot support portion 20 inwardly and rearwardly thereby tightening the front support 42 over or against the front 44 of the footwear 12. The cable 22 also pulls the attachment portions 52 peripherally inward thereby tightening the front lateral support 48 against the front lateral side of the footwear 12 and tightening the front medial support 50 against the front medial side of the footwear 12. The cable reel device 24 attaches the cable 22 to the upper support portion 54 near the upper end portion 54U of the upper support portion 54. Shortening the cable 22 pulls the cable reel device 24 rearwardly or inwardly thereby tightening the upper support portion 54 against the tongue or front of the footwear 12.

A footwear traction device 60 according to a second embodiment is shown in FIGS. 2A, 2B, 2C and 2D. A cable 62 of the footwear traction device 60 is removably attachable to a heel support portion 64 to facilitate easy insertion and removal of the footwear into and from a forefoot support portion 66. A first length of the cable 62 on a lateral side of the footwear traction device 60 extends rearwardly from the cable reel device 68, through a lateral cable attachment member 70, and extends into an attachment portion 72 of the forefoot support portion 66. A second length of the cable 62 on a medial side of the footwear traction device 60 extends from the cable reel device 68, through a second cable attachment member substantially similar to the cable attachment member 70, and extends into the attachment portion 72.

Figure 2A:
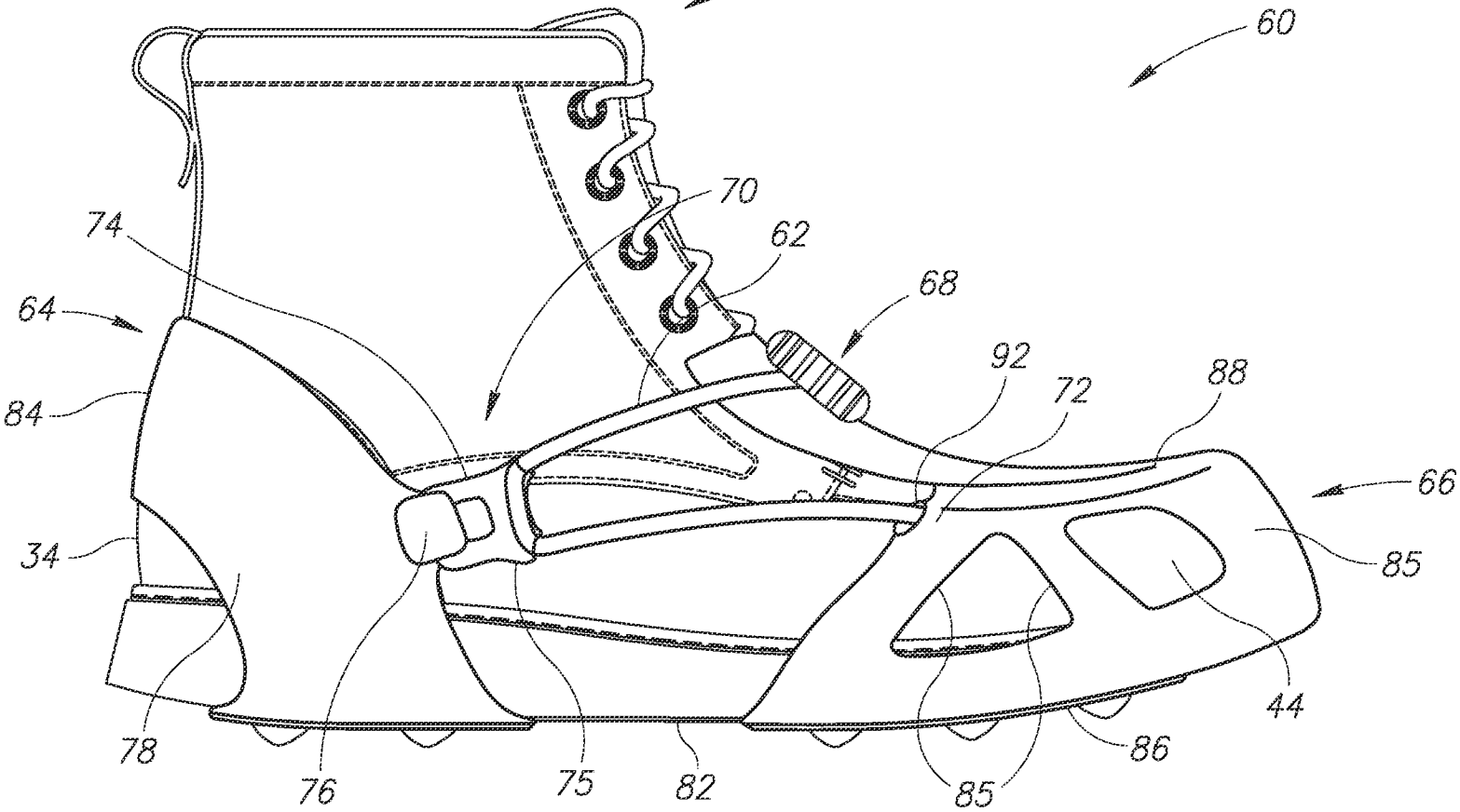
FIG. 2A illustrates a lateral side elevational view of a footwear traction device according to a second embodiment.
Figure 2B:
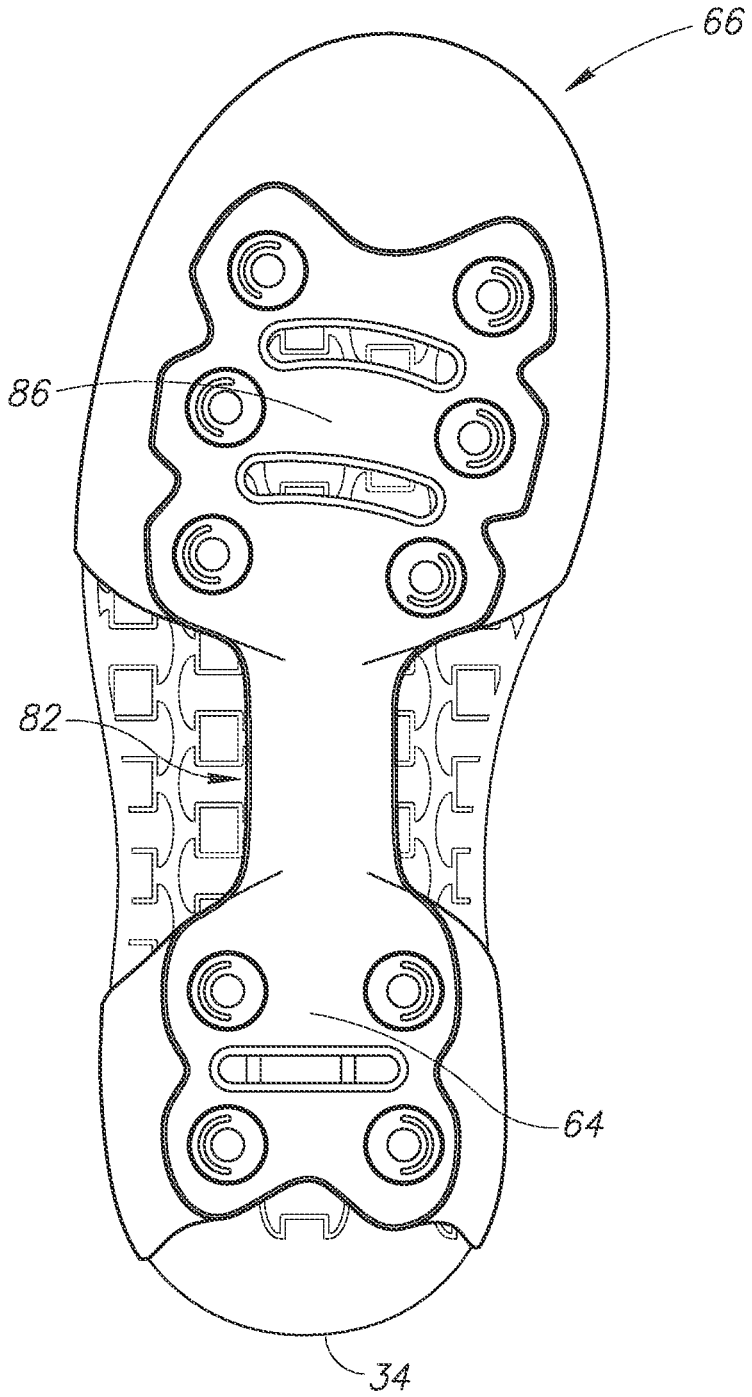
FIG. 2B illustrates a bottom plan view of the footwear traction device of FIG. 2A.
Figure 2C:
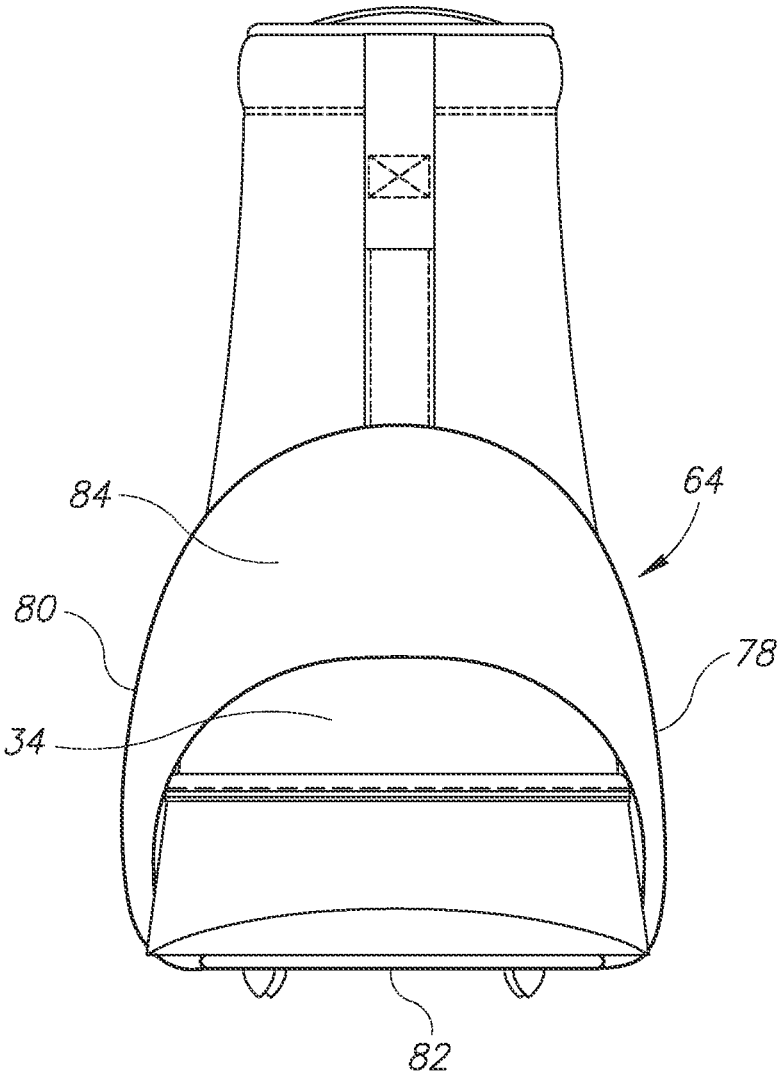
FIG. 2C illustrates a rear elevational view of the footwear traction device of FIG. 2A.
Figure 2D:
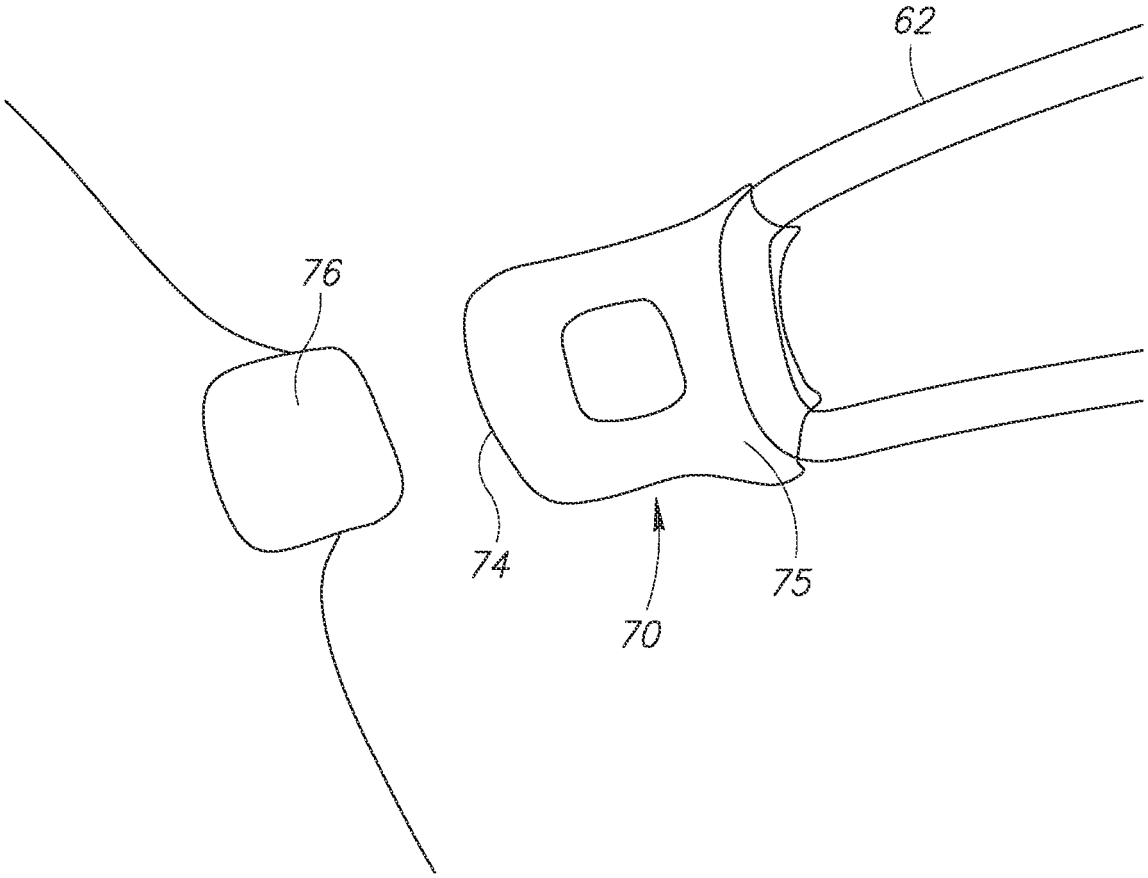
FIG. 2D illustrates an enlarged lateral side elevational view of a receptacle portion and a cable attachment member of the footwear traction device of FIG. 2A.

The cable attachment member 70 includes a fastening portion 74 and a cable guide or channel 75 through which the cable 62 extends, as shown in FIG. 2D. The fastening portion 74 may be selectively engaged or disengaged with a lateral receptacle portion 76 of the heel support portion 64 to facilitate easy insertion or removal of the footwear 12 into or from the forefoot support portion 66. The fastening portion 74 may be a rigid structure, such as a downwardly extending rod or a shaft, disposed on a rearward side of the cable attachment member 70. The receptacle portion 76 is positioned on a rear lateral sidewall 78 of the heel support portion 64 and is sized and shaped to securely receive the fastening portion 74. The receptacle portion 76 may be hook-shaped or engage with the fastening portion 74 in a snap-fit relationship to securely attach the cable 62 to the heel support portion 64. Alternatively, the fastening portion 74 may be disposed on the sidewall 78 and the receptacle portion 76 may be disposed on the cable attachment member 70. A medial receptacle portion substantially similar to the receptacle portion 76 may be provided on a rear medial sidewall 80 of the heel support portion 64 opposite to the rear lateral sidewall 78 to receive a medial cable attachment member substantially similar to the cable attachment member 70.

When the lateral cable attachment member 70 and the medial cable attachment member are respectively disengaged from the lateral receptacle portion 76 and the medial receptacle portion, respectively, the heel support portion 64 may be moved to a position allowing the front 44 of the footwear 12 to be positioned within the forefoot support portion 66. A flexible traction portion 82 of the footwear traction device 60 may be moved downwardly and/or the elastic heel support portion 64 stretched rearwardly to facilitate insertion of the footwear 12 into the forefoot support portion 66. After the front 44 of the footwear 12 is positioned within the forefoot support portion 66, a rear support 84 of the heel support portion 64 may be positioned against the heel portion 34 of the footwear 12, as shown in FIGS. 2A and 2C. The lateral cable attachment member 70 and the medial cable attachment member may then be respectively engaged with the receptacle portion 76 and the medial receptacle portion to attach the cable 62 and the forefoot support portion 66 to the heel support portion 64. Rotation of the cable reel device 68 in the section direction is operable to shorten the length of and increase the tension on the cable 62 to secure the footwear traction device 60 to the footwear 12.

This process may be reversed to remove the footwear traction device 60 from the footwear 12.

The forefoot support portion 66 of the footwear traction device 60 has a support wall 85 extending upwardly from lateral and medial sides and a front of a front body portion 86 of the traction member 82. The support wall 85 may comprise a unitary support wall structure, as shown in FIG. 2A, or may comprise separate support walls joined by a cable. An upper portion 88 of the front support portion 66 extends peripherally along an upper end of the support wall 85 and may connect a medial side, a front, and a lateral side thereof. The upper portion 88 includes the attachment portion 72 having a cable guide or channel extending through the medial side, the front, and the lateral side of the front support portion 66. The attachment portion 90 has a first aperture 92 on the lateral side and a second aperture on the medial side substantially similar to the first aperture for receiving the cable 62 in the cable guide. The cable 62 is slidable through the cable guide of the lateral cable attachment member 70 and medial cable attachment member 72. The cable reel device 68 is rotatably operable to selectively secure and unsecure the footwear traction device 60 in a manner substantially similar to the footwear traction device 10, so further description thereof is omitted. The bottom of the forefoot support portion 66 may extend peripherally outward from and surround the front body portion 86 of the traction member 82, as shown in FIG. 2B.

In some embodiments, ends of the cable 62 may be anchored in the attachment portion 72. For example, a first end of the cable 62 may be inserted into the first aperture 72 and fixedly attached to the front support portion 66 in the cable channel or guide of the attachment portion 90, and a second end of the cable may be inserted into the second aperture and fixedly attached to the front support portion in the cable guide.

Figure 3A:
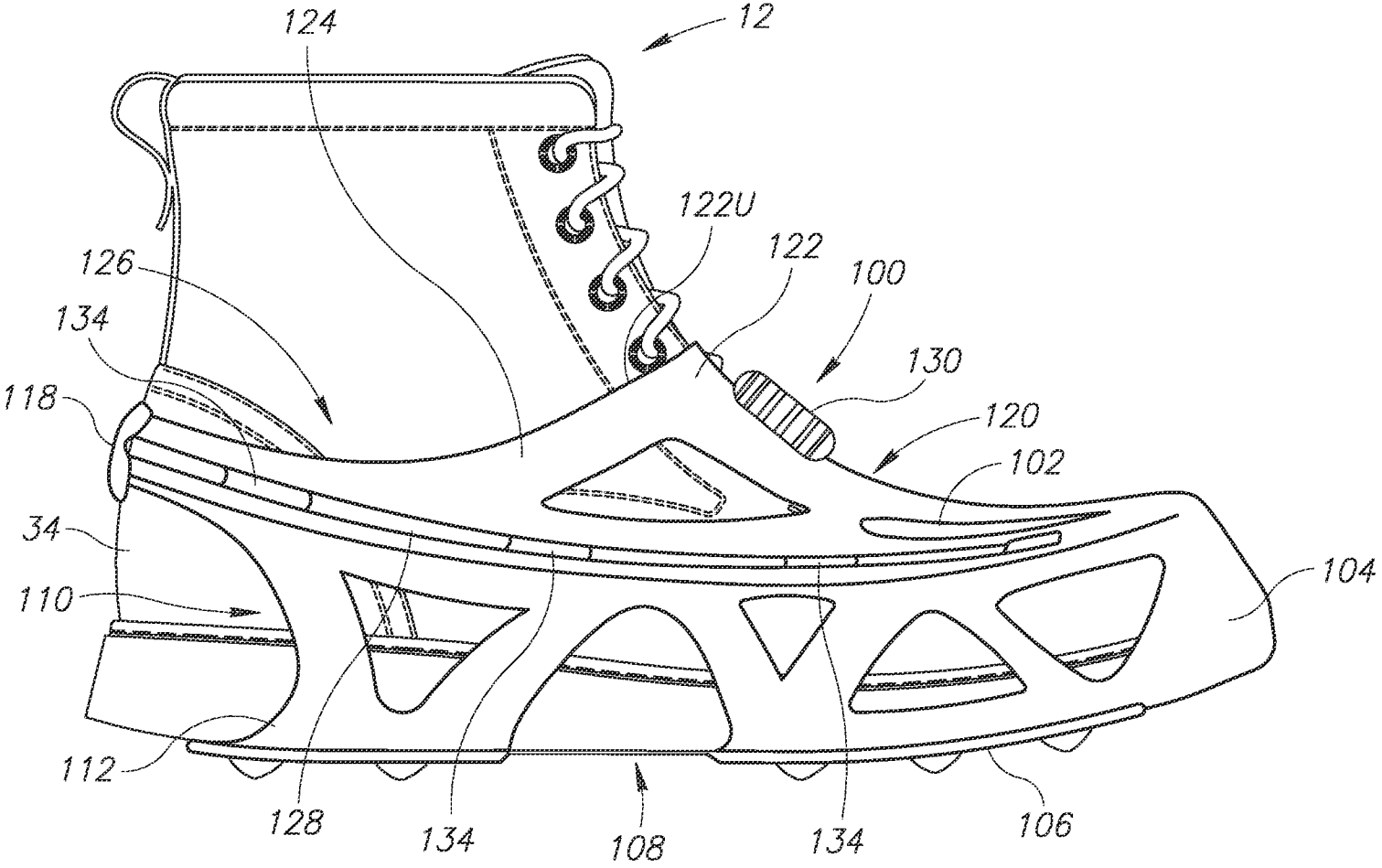
FIG. 3A illustrates a lateral side elevational view of the footwear traction device according to a third embodiment.
Figure 3B:
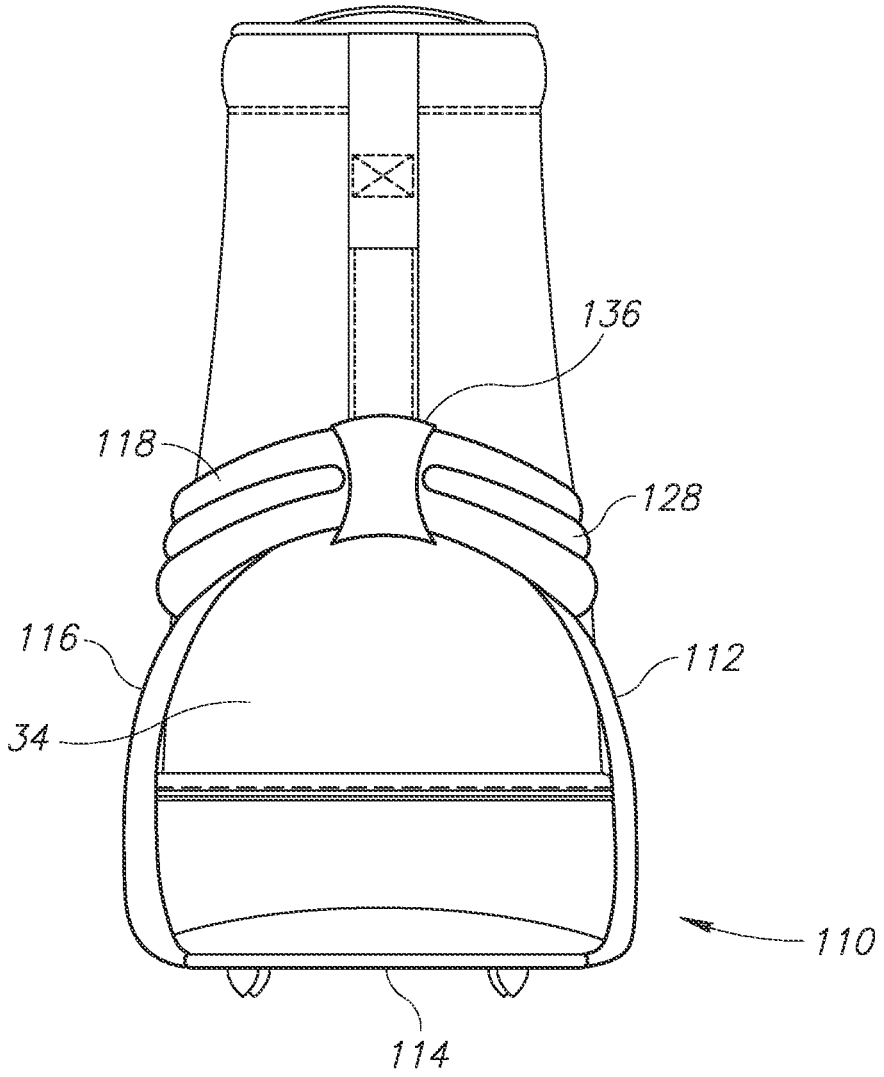
FIG. 3B illustrates a rear elevational view of the footwear traction device of FIG. 3A.
Figure 3C:
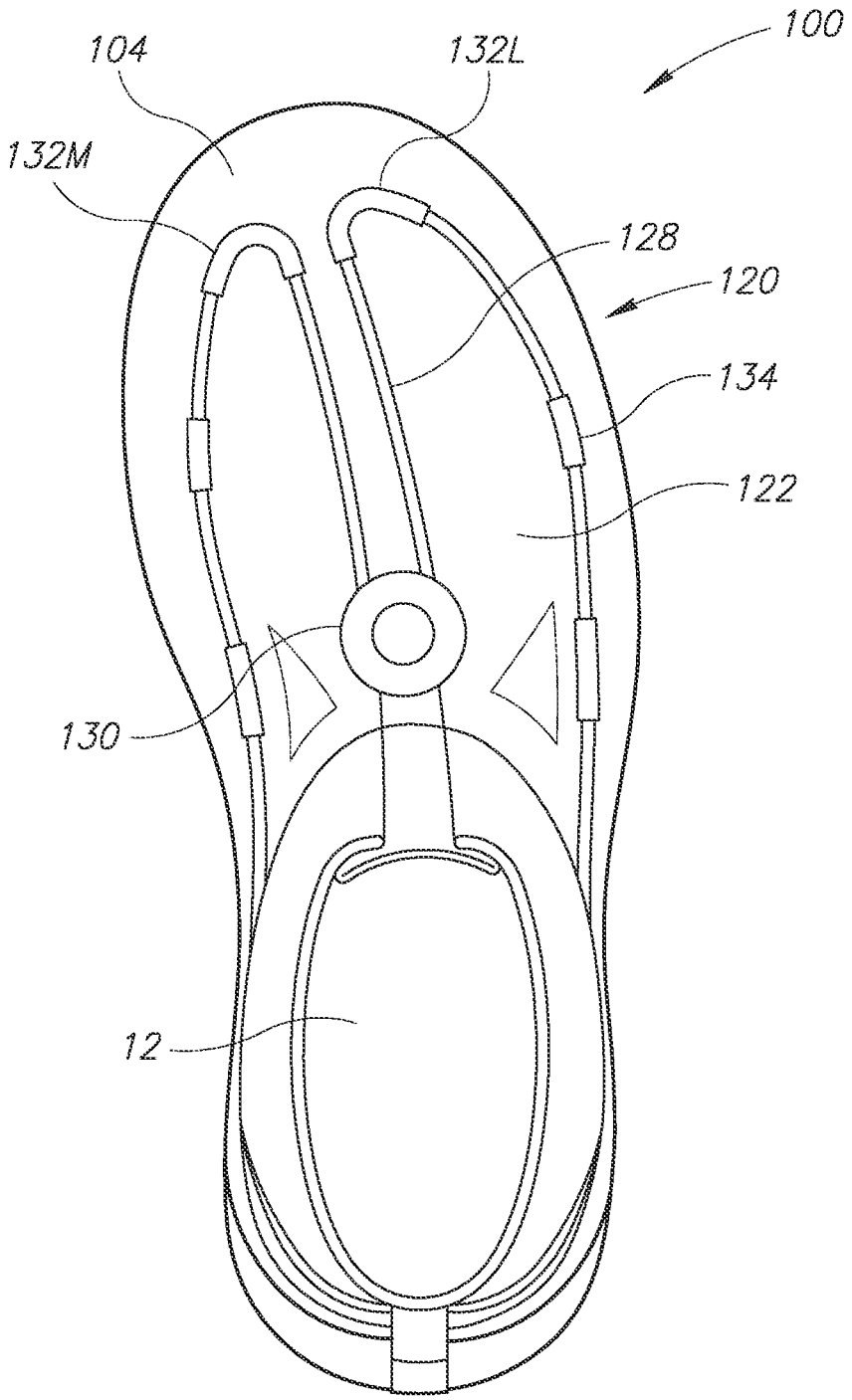
FIG. 3C illustrates a top plan view of a forefoot portion of the footwear traction device of FIG. 3A.

A footwear traction device 100 according to a third embodiment is shown in FIGS. 3A, 3B and 3C. The footwear traction device 100 has a forefoot support portion 102 having a support wall 104 extending upwardly from a front body portion 106 of a traction portion 108. A heel support portion 110 of the footwear traction device 100 has a rear lateral sidewall 112 extending upwardly from a lateral side of a rear body portion 114 of the traction portion 108, and a rear medial sidewall 116 extending upwardly from the medial side of the rear body portion, as shown in FIG. 3B. A rear support 118 extends between the rear lateral sidewall 112 and the rear medial sidewall 116 above a rearward end of the traction portion 108. The rear support 118 extends along and at least partially covers the back heel portion 34 of the footwear 12 when the footwear traction device 100 is attached thereto.

An upper support portion 120 has an upper support wall 122 extending inwardly and upwardly from a perimeter support wall portion at an upper end of the support wall 104. The upper support wall 122 extends above the front body portion 106 of the traction portion 108. The upper support wall 122 flexibly covers an upper forefoot portion of the footwear 12 when the footwear traction device 100 is attached thereto. Opposing side portions 124 of the upper support portion 120 extend rearwardly from the upper support wall 122 on lateral and medial sides of the footwear traction device 100. One of the side portions 124 joins with the rear lateral sidewall 112 on the lateral side and the other one of the side portions joins with the rear medial sidewall 116 on the medial side. The rear support 118 extends rearwardly from a rear end of each of the opposing side portions 124. A mouth 126 is provided for receiving the footwear 12 within the footwear traction device 100. The mouth 126 is defined by the upper support wall 122, the rear support 118, and the opposing side portions 124.

A cable 128 extends forwardly from a cable reel device 130, wraps rearwardly around a perimeter of the footwear traction device 100, and around the rear support 118. Specifically, a first length of the cable 128 extends forwardly and downwardly from the cable reel device 130 and into a lateral first attachment portion 132L. The first attachment portion 132L may have a cable guide or channel with a curved shape guiding the cable in a rearward direction and to the lateral side of the footwear traction device 100. Alternatively, the cable 128 may extend through a cable guide or channel or the first attachment portion 132L extending in a substantially horizontal direction (i.e., direction extending from the medial side to the lateral side). The cable 128 extends rearwardly from the first attachment portion 132L along a lateral perimeter of the upper support portion 120 or the front support portion 102.

The cable 128 may extend through one or more second attachment portions 134 disposed along the lateral perimeter of the upper support portion 120, the rear support 118 or the front support portion 102. Each of the second attachment portions 134 has a cable guide or channel extending longitudinally along the lateral perimeter. The cable 128 extends rearwardly along the rear support 118 and then into a rear attachment portion 136. In the present embodiment, the cable 128 passes through a cable guide or channel extending horizontally between a lateral side of the rear attachment portion 136 and a medial side of the rear attachment portion. In some embodiments, however, one or both ends of the cable 128 may be fixedly attached to a receptacle on or within the rear attachment portion 136.

A second length of the cable 128 extends forwardly and downwardly from the cable reel device 130 and into a medial first attachment portion 132M. The medial first attachment portion 132M is substantially similar to the lateral first attachment portion 132L except that the medial first attachment portion 132M guides the second length of the cable 128 toward a medial side of the footwear traction device 100. The second length of cable 128 extends along the medial side of the footwear traction device 100 in a manner substantially similar to the first length of the cable, so further description thereof is omitted.

The cable reel device 130 is operable adjust the length of the cable 128 to selectively secure and unsecure the footwear 12 positioned within the footwear traction device 100. Rotation of the cable reel device 130 in one direction shortens the length of the cable 128 and pulls the first attachment portions 132L and 132M rearwardly tightening an anterior portion of the front support wall 104 against a toe cap of the footwear 12 to which the footwear traction device 100 is attached. Shortening the cable 128 simultaneously pulls the cable inwardly and forwardly at along the rear support 118 inwardly tightening it against the heel portion 34 of the footwear 12. Shortening the cable 128 also pulls the cable upwardly and inwardly in the second attachment portions 134 tightening the sidewalls of the forefoot support portion 102 and the rear sidewalls 112 and 116 of the heel support portion 110 against sides of the footwear 12. The cable reel device 130 is operable in a manner similar to the cable reel device 24 described above to unsecure the footwear traction device 100 from the footwear 12 and allow insertion and removal of the footwear through the mouth 126.

Figure 4A:
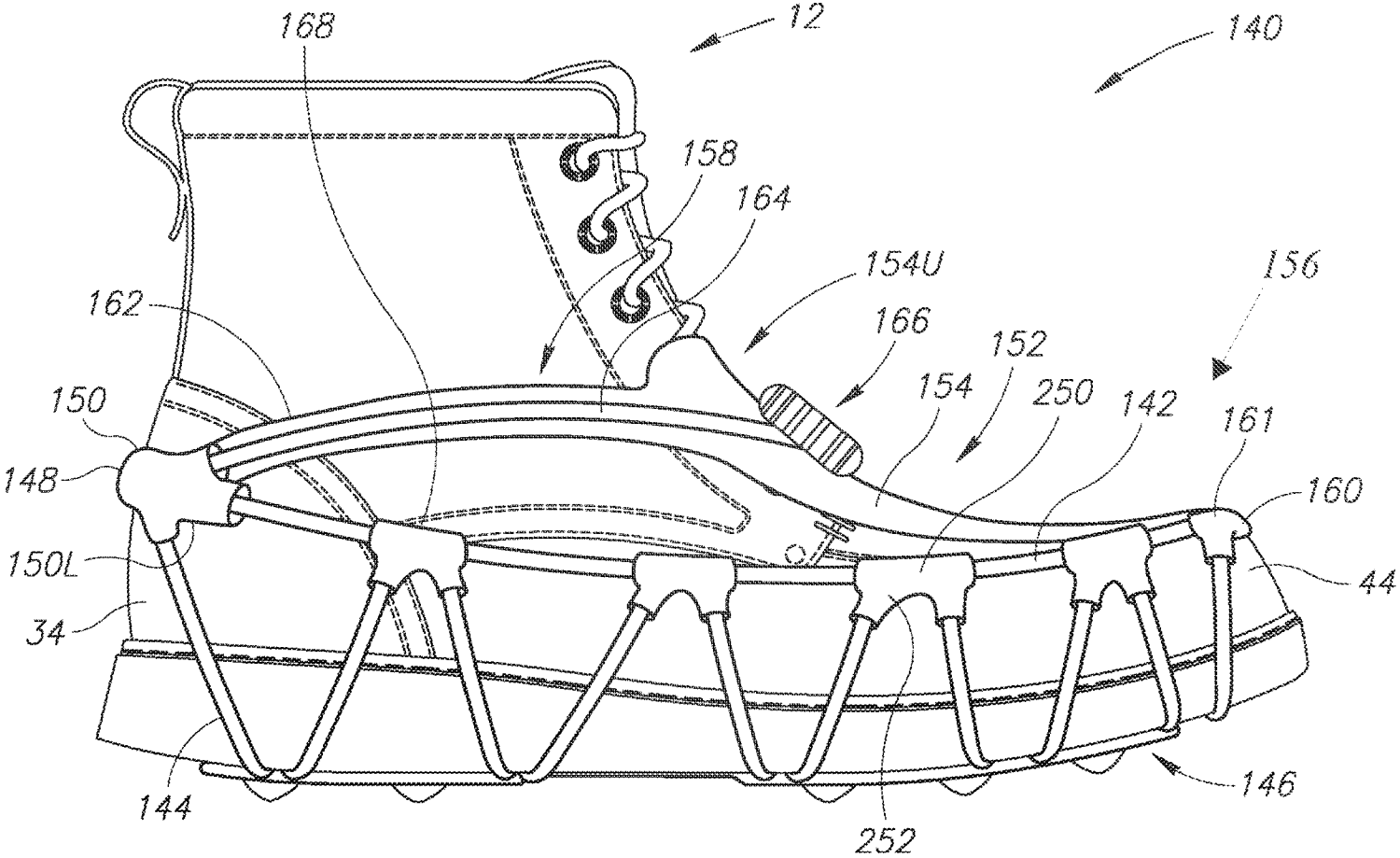
FIG. 4A illustrates a lateral side elevational view of the footwear traction device according to a fourth embodiment.
Figure 4B:
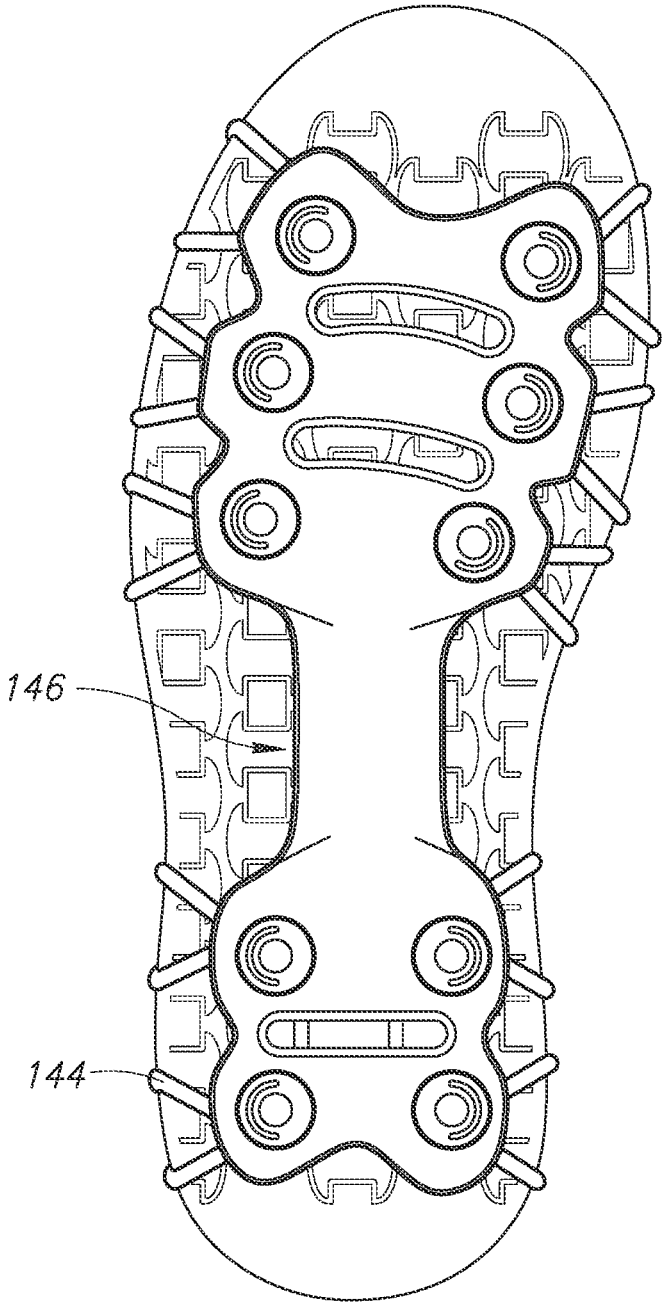
FIG. 4B illustrates a bottom plan view of the footwear traction device of FIG. 4A.
Figure 4C:
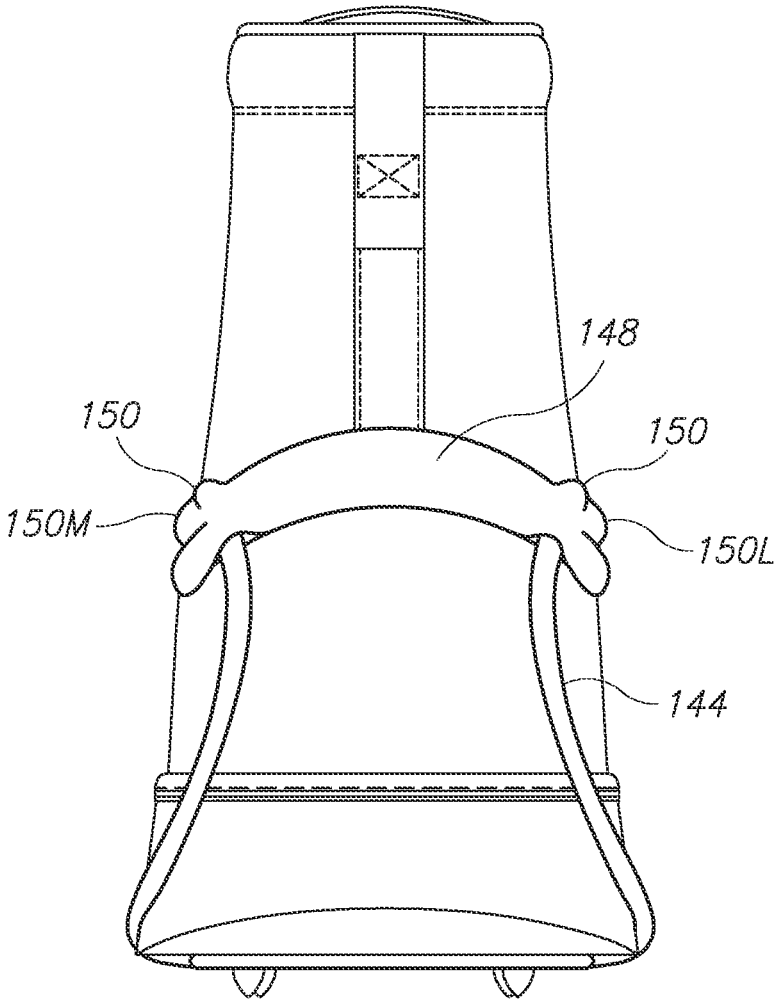
FIG. 4C illustrates a rear elevational view of the footwear traction device of FIG. 4A.

A footwear traction device 140 according to a fourth embodiment is shown in FIGS. 4A, 4B, 4C, 4D and 4E. The footwear traction device 140 has more than one cable for securely attaching to an item of footwear 12. The footwear traction device 140 includes a first cable 142 extending around a perimeter of the footwear 12 when the footwear traction device is attached thereto, and a second cable 144 extending back and forth upwardly and downwardly between the first cable 142 and a traction member 146 along the sides of the footwear. A flexible or elastic rear support 148 is positioned at a rearward end of the footwear traction device 140 and extends horizontally between a lateral side and a medial side thereof, as shown in FIG. 4C. The footwear traction device 140 has two attachment members 150 attached to the rear support 148, including a lateral first attachment portion 150L disposed on a lateral portion of the rear support 148, and a medial first attachment portion 150M substantially similar to the lateral first attachment portion disposed on a medial portion of the rear support 148. The first cable 142 extends forwardly out of a cable guide or channel of the first attachment portion 150L along the lateral side perimeter of the footwear traction device 140. The second cable 144 extends downwardly from a cable guide or channel of the first attachment portion 150L and attaches to the traction member 146, as shown in FIG. 4B.

The footwear traction device 140 has an upper support portion 152 sized and shaped to cover an upper forefoot portion of the footwear 12 when the footwear traction device is attached thereto. The upper support portion 152 may have a forefoot support body 154 positioned above the traction member 146 and extending rearwardly from a front section 156 to an upper end portion 154U. The upper support body 154 may have a thin elongated shape comprised of a pliable material. The front section 156 may have an anterior portion 160 that bends downwardly to at least partially wrap around a toe box or toe tip of the footwear 12. The front section 156 may have a front cable guide or channel 161 configured to guide a length of the first cable 142 or the second cable 144 between lateral and medial sides of the footwear traction device 140 at or near the front.

Side supports 162 of the upper support portion 152 may extend rearwardly near or at an upper end 154U of the upper support body 154 and join with lateral and medial sides of the rear support 148. The rear support 148, the upper end 154U of the upper support body 154, and opposing lateral and medial sides of the side support 162 define an upwardly opening mouth 158 for receiving the footwear 12 within the footwear traction device 140. A first cable length 164 extends rearwardly from each of the lateral and medial sides of the upper support portion 154 along the side support 162 and into a cable guide or channel of the rear support 148. The first cable lengths 164 extend into and are operably connected with a cable reel device 166 positioned on an outwardly facing surface of the upper support portion 152.

Figure 4D:
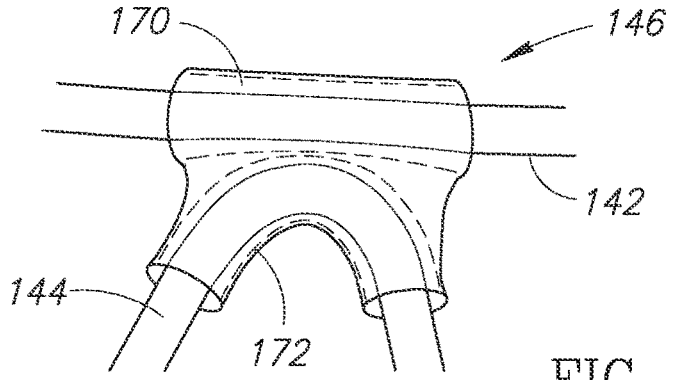
FIG. 4D illustrates a cross-sectional view of a side support member of the footwear traction device of FIG. 4A.

One or more side support members or braces 168 are longitudinally positioned along lateral and medial sides of the footwear traction device 140 between the rear support 148 and the front portion 156 of the upper support portion 154 and above the traction member 146. Each of the side support members 168 have an upper cable guide or channel 170 extending in a substantially horizontal direction therethrough, and a lower cable guide or channel 172 having a concave downward shape along its length, as shown in FIG. 4D. The lower cable guide 172 extends upwardly at an angle with respect to the horizontal direction then curves or turns downwardly at an angle with respect to the horizontal direction. Although the side support members 168 have a cross-sectional K-shape in the present embodiment, other shapes are contemplated. The side support members 168 may have a flat or concave support plate facing peripherally inward to contact the footwear 12 when the footwear traction device 140 is attached thereto. Five side support members 168 are positioned on each of the lateral and medial sides of the footwear traction device 140 in the present embodiment; however, a different number of side support members may be provided without departing from the scope of the footwear traction device.

The first cable 142 extends forwardly from the lateral first attachment portion 150L and through the upper cable guides 170 of each of the side support members 168 on the lateral side. The first cable 142 extends forwardly from a frontmost one of the side support members 168 and into the front cable guide 161 which guides the first cable 142 from the lateral side over to the medial side along the front of the footwear traction device 140. After exiting the front cable guide 161 on the medial side, the first cable 142 extends rearwardly through the upper cable guides 170 of each of the side support members 168 on the medial side, and extends into or attaches to the medial first attachment portion 150M. The first cable 142 may have a thicker diameter than the second cable 144 or visa-versa.

Figure 4E:
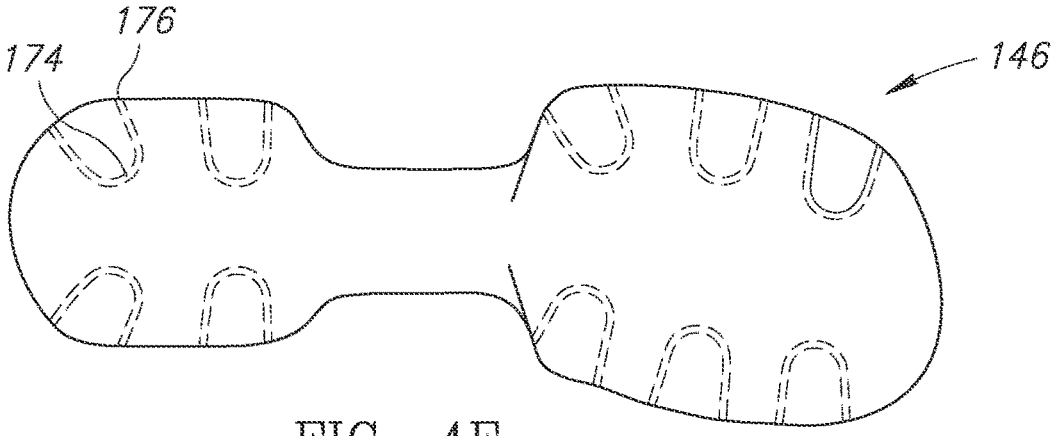
FIG. 4E illustrates a cross-sectional bottom view of a traction portion of the footwear traction device of FIG. 4A.

The lateral side and the medial side of the traction section 146 each include a plurality of traction section cable guides 174, as shown in FIG. 4E. The cable guides 174 have a laterally outwardly concave, curved or arcuate shape extending internally within and along the length of the traction section 146. Each of the cable guides 174 has a pair of apertures 176 respectively positioned at opposite ends thereof along sides of the traction section 146 allowing for insertion of the second cable 144 therethrough. In the present embodiment, the cable guides 174 are horizontally oriented; however, one or more of the cable guide may be vertically oriented and extend upwardly from sides of the traction section 146.

The second cable 144 extends downwardly from the lateral first attachment portion 150L and into one of the apertures 176 of a rearmost cable guide 174. The second cable 144 extends through the length of the cable guide 174 and out from the other one of the apertures 176. The second cable 144 extends upwardly from the traction section 146 and through the lower cable guide 172 of a rearmost side support member 168. The second cable 144 extends downwardly from the rearmost side support member 168, through the cable guide 174 forwardly adjacent to the rearmost traction section cable guide, and upwardly through the lower cable guide 172 of the side support member 168 forwardly adjacent to the rearmost side support member. The second cable 144 extends upwardly and downwardly back and forth in V-shaped or U-shaped formations along the side of the footwear traction apparatus 140. At the front of the footwear traction device 140, the second cable 144 extends upwardly from a forward most one of the traction section cable guides 174 and through the front cable guide 161 to the medial side of the footwear traction device. In some embodiments, however, the second cable 144 may extend to the medial side of the footwear traction device 140 through a cable guide extending through the traction section 146 from the lateral side to the medial side thereof. The second cable 144 extends on the medial side of the footwear traction device 140 to the medial first attachment portion 150M traveling a reverse path to the path described above with respect to the lateral side.

Figure 4F:
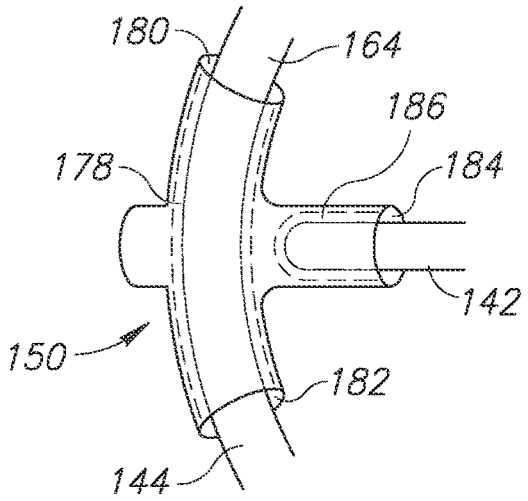
FIG. 4F illustrates a cross-sectional side view of a first attachment portion of the footwear traction device of FIG. 4A according to a first variation.

In one variation, the second cable 144 and the first cable length 164 are a continuous length of cable extending through the first attachment portions 150, as shown in FIG. 4F, on both the lateral and medial sides of the footwear traction device 140. The attachment portion 150 has a cable guide 178 extending downwardly between and connecting an upper aperture 180 and a lower aperture 182. The continuous length of cable extends into the upper aperture 180, through the downwardly extending cable guide 178, and downwardly out of the lower aperture 182. The continuous length of cable is slidable through the cable guide 178. A first end of the first cable 142 extends into a front aperture 184 of the lateral first attachment portion 150L and is fixedly retained within a forwardly opening cable receptacle 186 of the lateral first attachment portion 150L. A second end of the first cable 142 extends into a front aperture of the medial first attachment portion 150M and is fixedly retained within a forwardly opening cable receptacle of the medial first attachment portion 150M. The cable reel device 166 is operable to adjust the length of the continuous length of cable (i.e., the second cable 144 and the first cable length 164) to selectively secure and unsecure the footwear traction device 140 to the footwear 12. The first cable 142 of the present embodiment is a fixed length cable extending forwardly from the first attachment portions 150M and 150L, through the upper cable guides 170 of the side support members 168, and through the front cable guide 161. Rotating the cable reel device 166 in the second rotational direction is operable to shorten the continuous length of cable to secure of the footwear 12 in the footwear traction device 140. In particular, shortening the continuous length of cable mutually tightens the rear support 148 forwardly against the heel portion 34 of the footwear 12 and tightens the upper support portion 152 against the top, front and sides of the footwear. Simultaneously, shortening the continuous length of cable mutually pulls the traction section 146 upwardly and pulls the first cable 142 and side support members 168 suspending the traction section downwardly. The second cable 144 compresses inwardly against the outersole 17 and sides of the footwear 12. Rotation of the cable reel device 168 in the opposite second direction is operable to lengthen the continuous length of cable to unsecure the footwear 12 and thereby allow removal of the footwear from the footwear traction device 140.

Figure 4G:
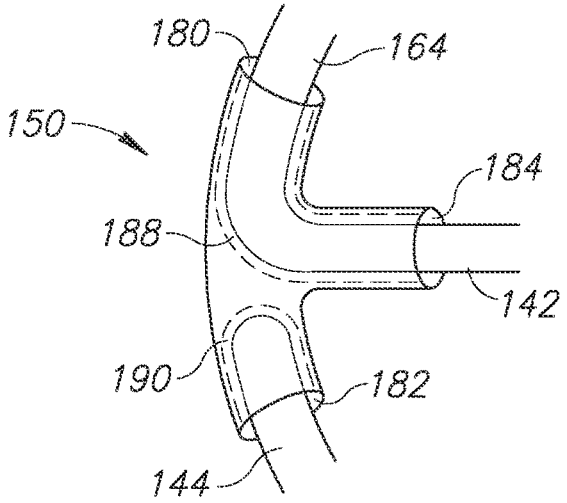
FIG. 4G illustrates a cross-sectional side view of a first attachment portion of the footwear traction device of FIG. 4A according to a second variation.

In a second variation, the first cable 142 and the first cable length 164 are a continuous length of cable extending through the first attachment portion 150, as shown in FIG. 4G. The attachment portions 150 on both the lateral and medial sides of the footwear traction device 140 have a cable guide 188 extending between and connecting the upper aperture 180 and the front aperture 184. The cable guide 188 may have a curved shape curving forwardly from the upper aperture 180 toward the front aperture 184. The continuous length of cable (i.e., the first cable 142 and the first cable length 164) extends into the upper aperture 180, through the cable guide 188, and forwardly out of the front aperture 184. The continuous length of cable is slidable through the cable guide 188. A first end of the second cable 144 extends into the lower aperture 182 of the first attachment portion 150 and is fixedly retained within a downwardly opening cable receptacle 190 of the attachment portion 150.

In the second variation, the cable reel device 166 is also operable to adjust the continuous length of cable (i.e., the first cable 142 and the first cable length 164) to selectively secure and unsecure the traction device 140 to the footwear 12. The second cable 144 is a fixed length cable extending back and forth up-and-down between the traction section 146 and the first cable 142. Shortening the continuous length of cable mutually tightens the rear support 148 forwardly against the heel portion 34 of the footwear 12 and tightens the upper support portion 152 against the top, front and sides of the footwear. Simultaneously, shortening the continuous length of cable draws the first cable 142 upward and inwardly against the footwear 12, pulling the second cable 144 upward and thereby tightening the traction section 146 against the outer sole 17. The V-shaped formations of the second cable 144 are also compressed inwardly against sides of the footwear 12.

The system of cables and side support members or braces in the footwear traction device 140 reduces the amount of materials used. By using cables and smaller side supports, frames and/or sidewalls (e.g., sidewalls 36, 38, 48, and 50 of footwear traction device 10) may be at least partially omitted, reducing the weight and cost of the device. In some embodiments, the cables 142 and 144 may extend through sidewalls or frame-like structures may be provided on the footwear traction device 140 for protecting the cables from snagging, cutting or ablating.

Figure 5A:
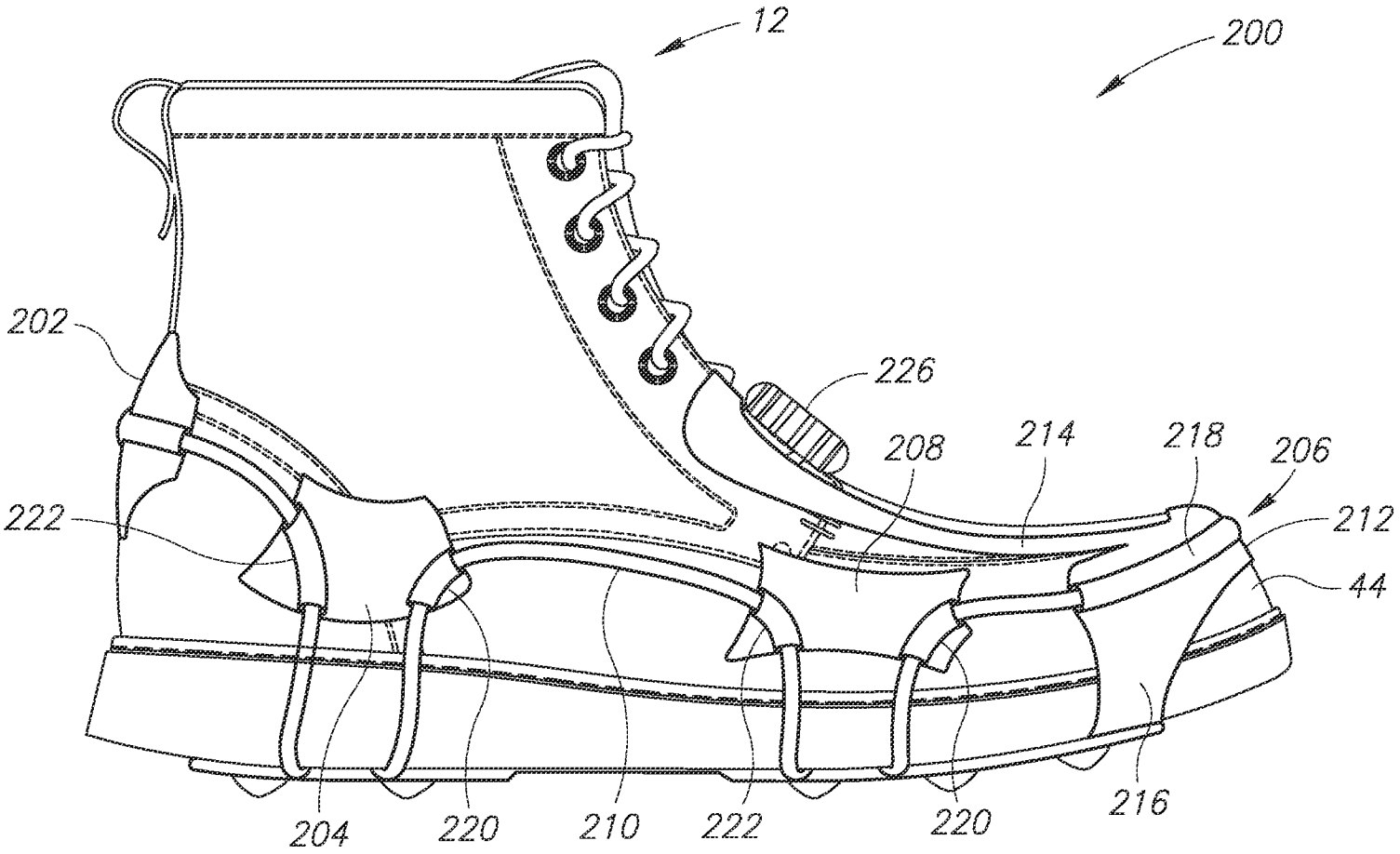
FIG. 5A illustrates a lateral side elevational view of a footwear traction device according to a fifth embodiment.
Figure 5B:
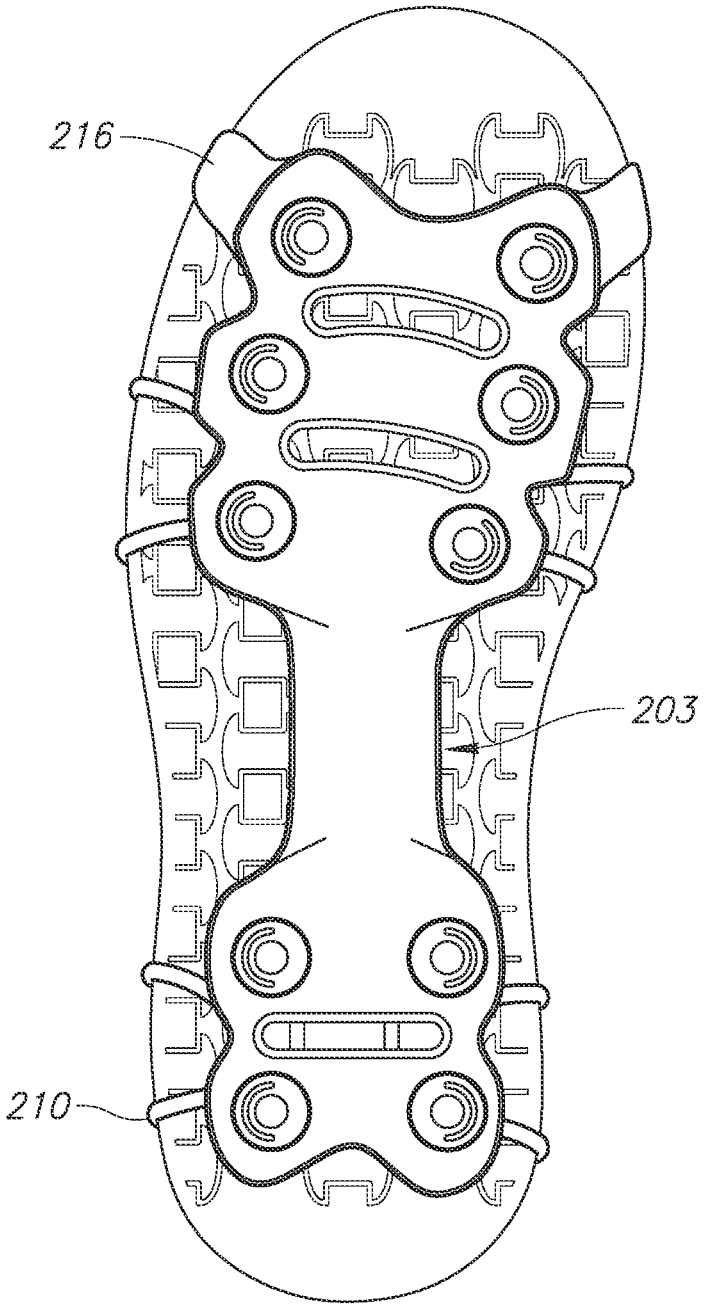
FIG. 5B illustrates a bottom plan view of the footwear traction device of FIG. 5A.

A footwear traction device 200 according to a fifth embodiment is illustrated in FIG. 5A. The footwear traction device 200 includes several support panels that compress inwardly against the footwear 12 when the length of the cable shortened. The footwear traction device 200 includes a rear support panel 202 disposed above a rear end portion of a traction section 203, two first side support portions 204 including lateral and medial first side support panels 204L and 204M disposed on opposite sides of the traction device above the traction section, and a forefoot support portion 206 disposed above a front end of the traction section 203. The footwear traction device may further include lateral and medial second side support panels 208 disposed on opposite sides of the traction device above the traction section 203, each respectively positioned longitudinally between the forefoot support portion 206 and the lateral and the medial first side support panels 204L and 204M. A cable 210 extends between and connects the rear support panel 202, the traction section 203, the first side support portions 204, the second side support portions 208 and the forefoot support portion 206 together.

The forefoot support portion 206 has a front support portion 212 extending from the lateral side to the medial side of the footwear traction device 200. The front support portion 212 may have a cup or curved shape to snuggly receive the front 44 of the footwear 12. An upper support portion 214 having an elongated shape extends upwardly and rearwardly from a center portion of the front support portion 212. One or more support members 216 extend downwardly connecting the front support portion 212 to the front of the traction section 203. A cable guide or channel 218 on the forefoot support portion 206 has a curved or arcuate shape extending along the front of the forefoot support portion for receiving and guiding the cable 210 rearwardly toward a cable reel device 226.

The first side support portions 204 and the second side support portions 208 each have a first cable guide or channel 220 curving downwardly from a front end toward a bottom end, and a second cable guide or channel 222 curving downwardly from a rear end toward the bottom end. The rear support panel 202 has a rear cable guide or channel 224 extending from a lateral side to a medial side of the footwear traction device 200. The traction section 203 is provided with a plurality of traction section cable guides substantially similar to the cable guides 174 described above.

Figure 5C:
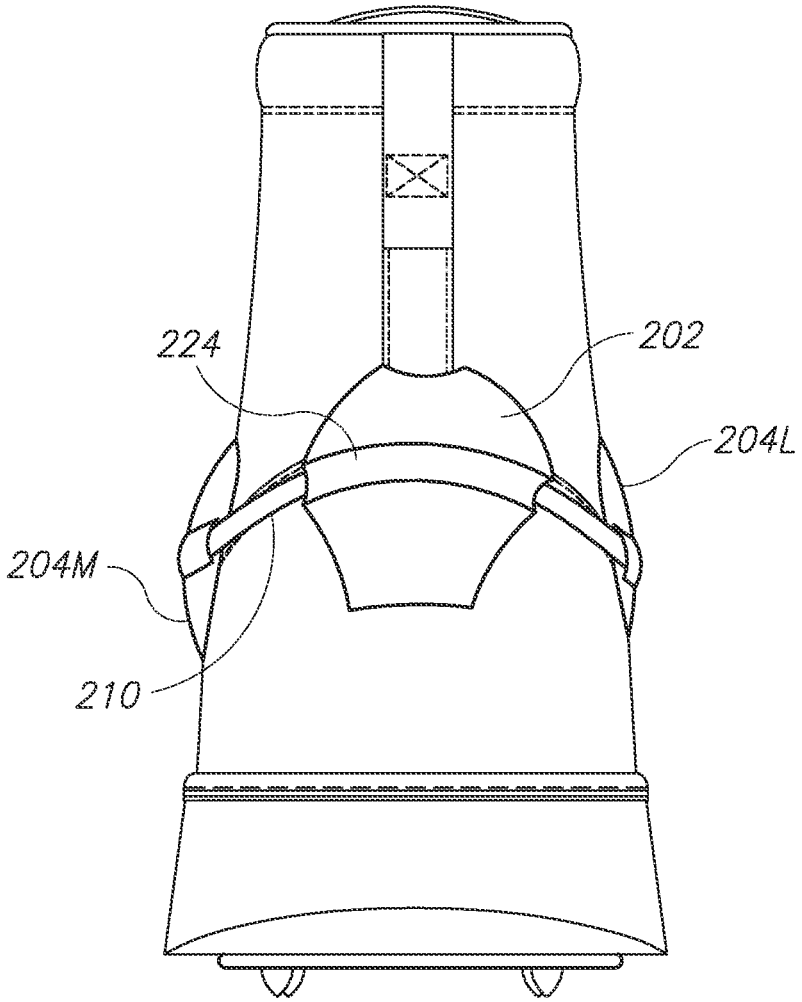
FIG. 5C illustrates a rear elevational view of the footwear traction device of FIG. 5A.

The cable 210 extends forwardly and downwardly from the cable reel device 226 on the upper support portion 214, through the cable guide 218, then rearwardly through into the first cable guide 220 of the second side support panel 208. The cable 210 extends downwardly through a traction section cable guide and then back upwardly through the second cable guide 222 of the second side support panel 208. The cable 210 passes through the first and second cable guides 220 and 222 of the first side support portion 204 and the traction section cable guide in a manner substantially similar to the second side support panel 208. The cable 210 extends rearwardly from the second cable guide 222 of the first side support panel 204 and into the lateral side and through the rear cable guide 224 of the rear support panel 202, as shown in FIG. 5C. The cable 210 extends forwardly from the medial side of the rear support panel 202 travels back to the cable reel device 226 along a reverse path to the path described above with respect to the lateral side.

Figure 6A:
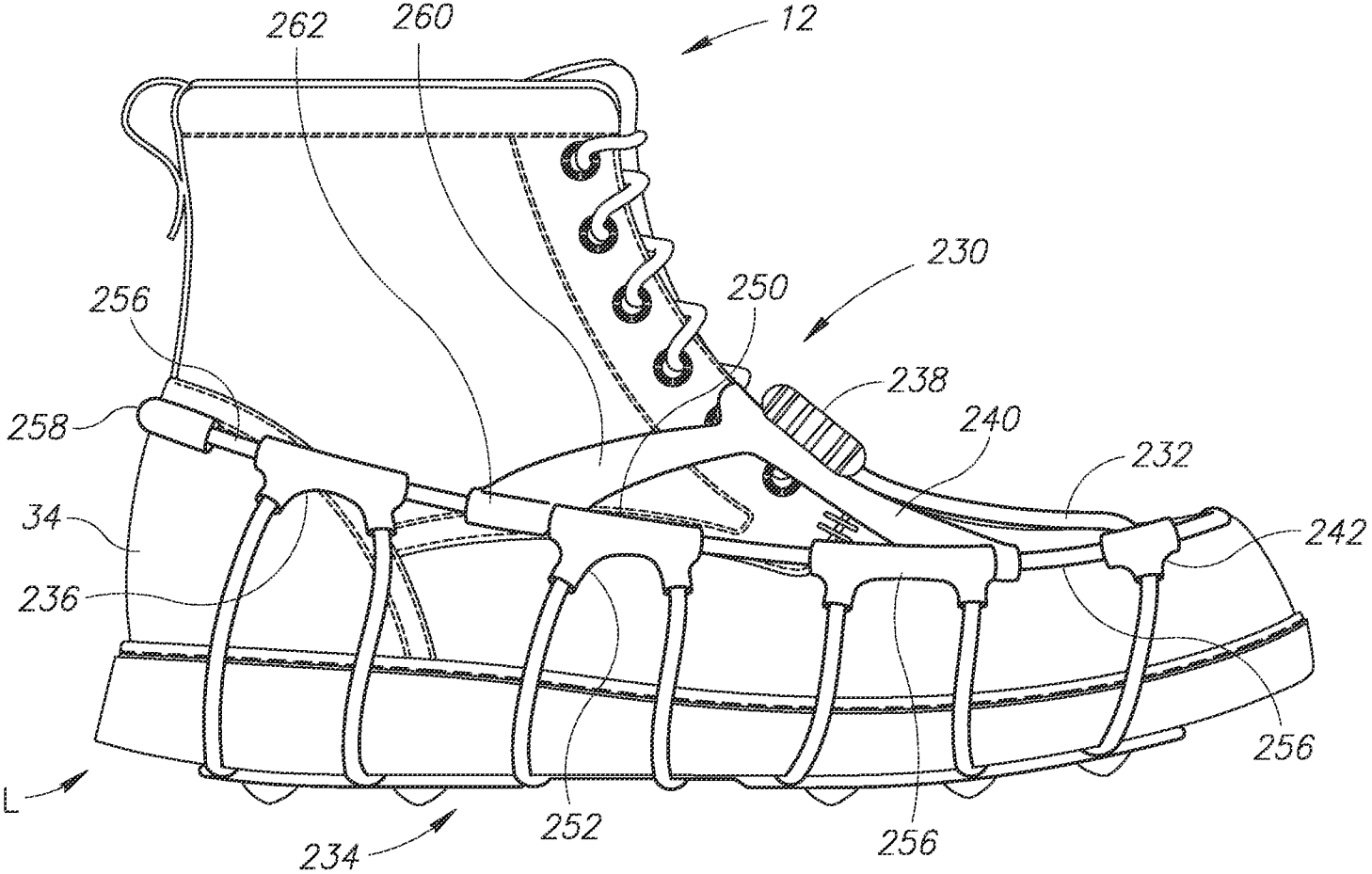
FIG. 6A illustrates a lateral side elevational view of a footwear traction device according to a sixth embodiment.
Figure 6B:
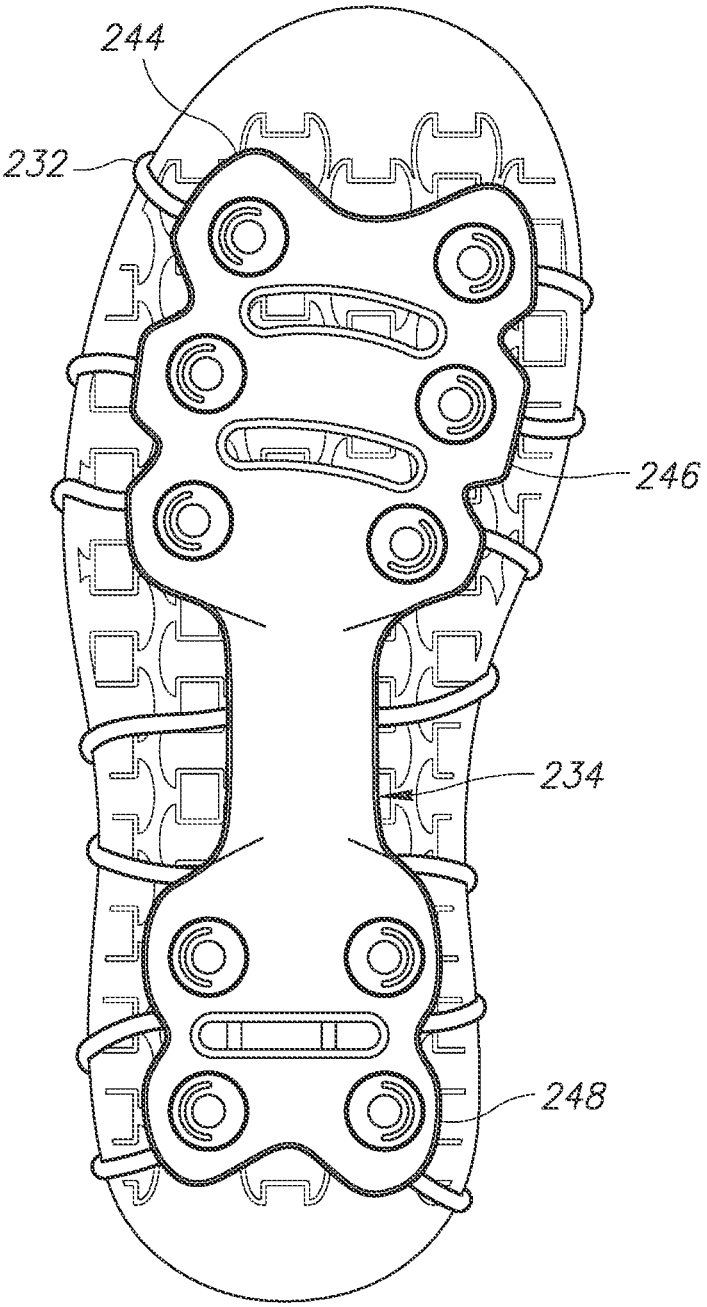
FIG. 6B illustrates a bottom plan view of the footwear traction device of FIG. 6A.

A footwear traction device 230 is shown in FIG. 6A according to a sixth embodiment. A cable 232 is woven back and forth through a width of a traction section 234 between side support members 236 on lateral and medial sides of the footwear traction device 230. The traction section 234 includes a plurality of cable guides or channels 244 extending horizontally from the lateral side to the medial side thereof, as shown in FIG. 6B. The cable guides 244 are hollow guides or channels extending internally through a width of the traction section 234. The cable guides 244 are spaced apart from each other along a length of the traction section 234 from a forefoot traction section 246 to a heel traction section 248. The side support members 236 may each have an upper cable guide 250 and a lower cable guide 252 substantially similar to the upper cable guide 170 and the lower cable guide 172 of the side support member 168 discussed above.

Figure 6C:
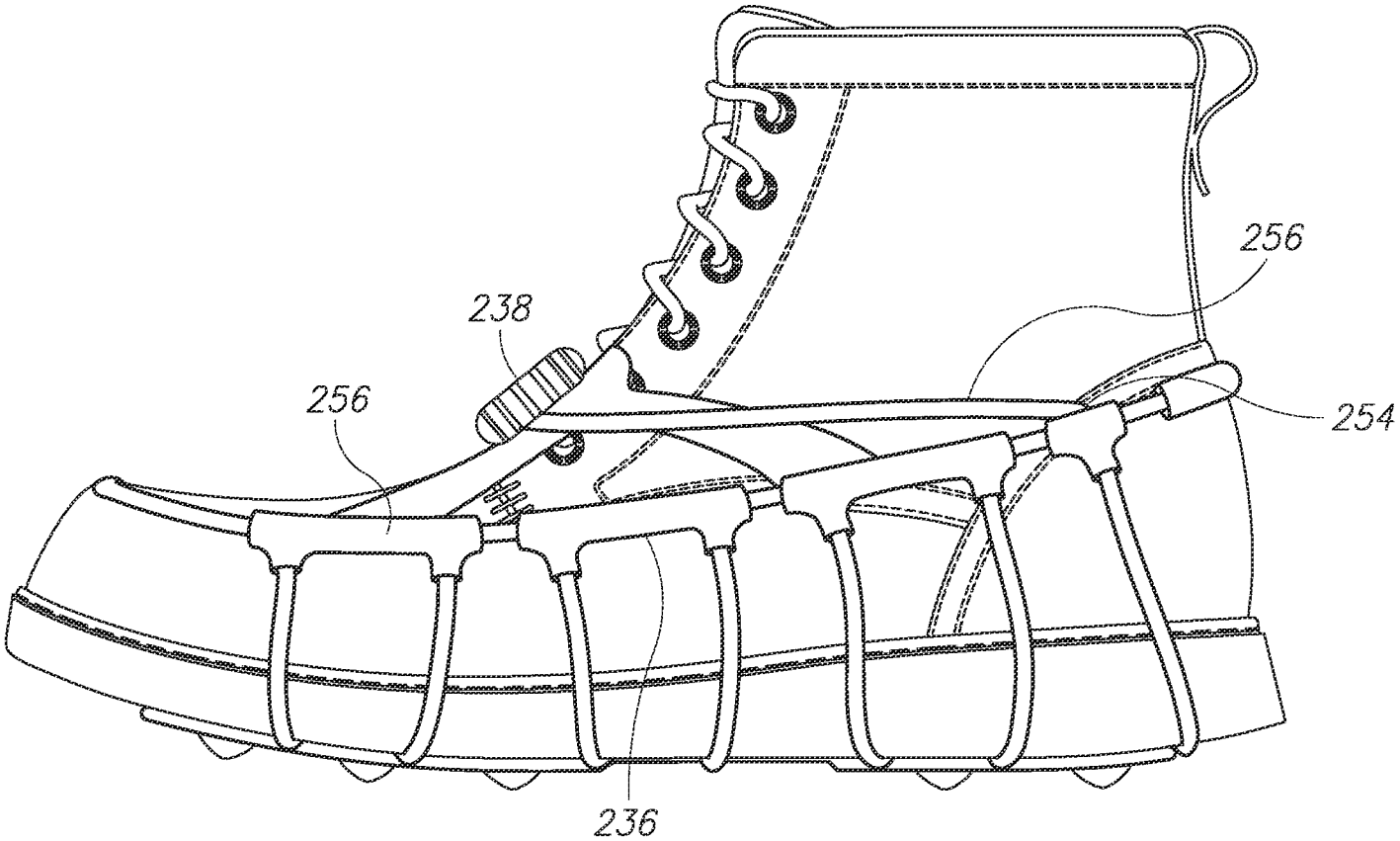
FIG. 6C illustrates a medial side elevational view of the footwear traction device of FIG. 6A.

A first end of the cable 232 of the footwear traction device 230 extends downwardly and forwardly from a cable reel device 238 disposed on an outwardly facing surface of an upper support portion 240, as shown in FIG. 6A. The cable 232 extends laterally into a cable guide or channel of a forward support member 242, through the cable guide, and then downwardly from the cable guide and toward the forefoot section 246 of the traction section 234. The cable 232 extends into a lateral side opening of a frontmost cable guide 244 on the forefoot traction section 246, through the length of the cable guide, and out from a medial side opening of the cable guide. The cable 232 extends upwardly from the forefoot traction section 246 and into the lower cable guide 252 of the forward most side support member 236 on the medial side of the footwear traction device 230. The cable 232 then extends back downwardly from the lower cable guide 252, into the medial side opening of the cable guide 244 rearwardly adjacent to the frontmost cable guide, through the cable guide and upwardly through a forward most side support member 236 on the lateral side of the footwear traction device 230. The cable 232 winds back and forth between side support members 236 on lateral and medial sides of the footwear traction device 230 in this manner along the length of the traction section 234. The cable 232 extends upwardly from a medial side of the rearmost cable guide 244 of the heel traction section 248, through a cable guide of a rear support member 254, and then forwardly along the medial side of the footwear traction device 230 toward the upper support portion 240, as shown in FIG. 6C. A second end of the cable 232 extends into the cable reel device 238 from the medial side of the footwear traction device 230.

A second cable 256 extends along the rear and the lateral and medial sides of the footwear traction device 230 in a manner similar to the first cable 142 described above. In particular, the first end of the second cable 256 may be fixedly attached within a receptacle of the forward support member 242. The second cable 250 extends rearwardly from the forward support member 242 along the lateral side of the footwear traction device 230 and through each of the upper cable guides 250 of the side support members 236. The second cable 256 extends into a lateral side opening of a cable guide of a rear support 258 positioned above a rear end of the traction section 234 and exits a medial side opening of the rear support 258. The second cable 256 extends forwardly through the upper cable guides 250 of side support members 236 positioned along the medial side of the footwear traction device 230, and fixedly attaches to a receptacle in the forward most support member 236 on the medial side. A flexible side support 260 may extend downwardly and/or rearwardly from lateral and medial sides of the upper support portion 240 and connect the upper support portion with the second cable 256. The second cable 256 extends through a cable guide or channel of an attachment portion 262 disposed on a lower end of the side support 260. The attachment portion 262 may be longitudinally positioned between two adjacent ones of the side support members 236 and slidably receive the second cable 262 as it passes from one to the other. The second cable 256 may be slidable within the cable guides.

The cable reel device 238 is operable to adjust the length of the cable 232 and thereby selectively secure and unsecure the footwear traction device 230 to the footwear 12 in a manner similar to the footwear traction device 140. Shortening the length of the second cable 256 pulls the traction section 234 upward, the upper support portion 240 downward and/or rearward, and the rear support 258 forward against the heel portion 34 of the footwear 12 positioned in the footwear traction device 230.

Figure 7A:
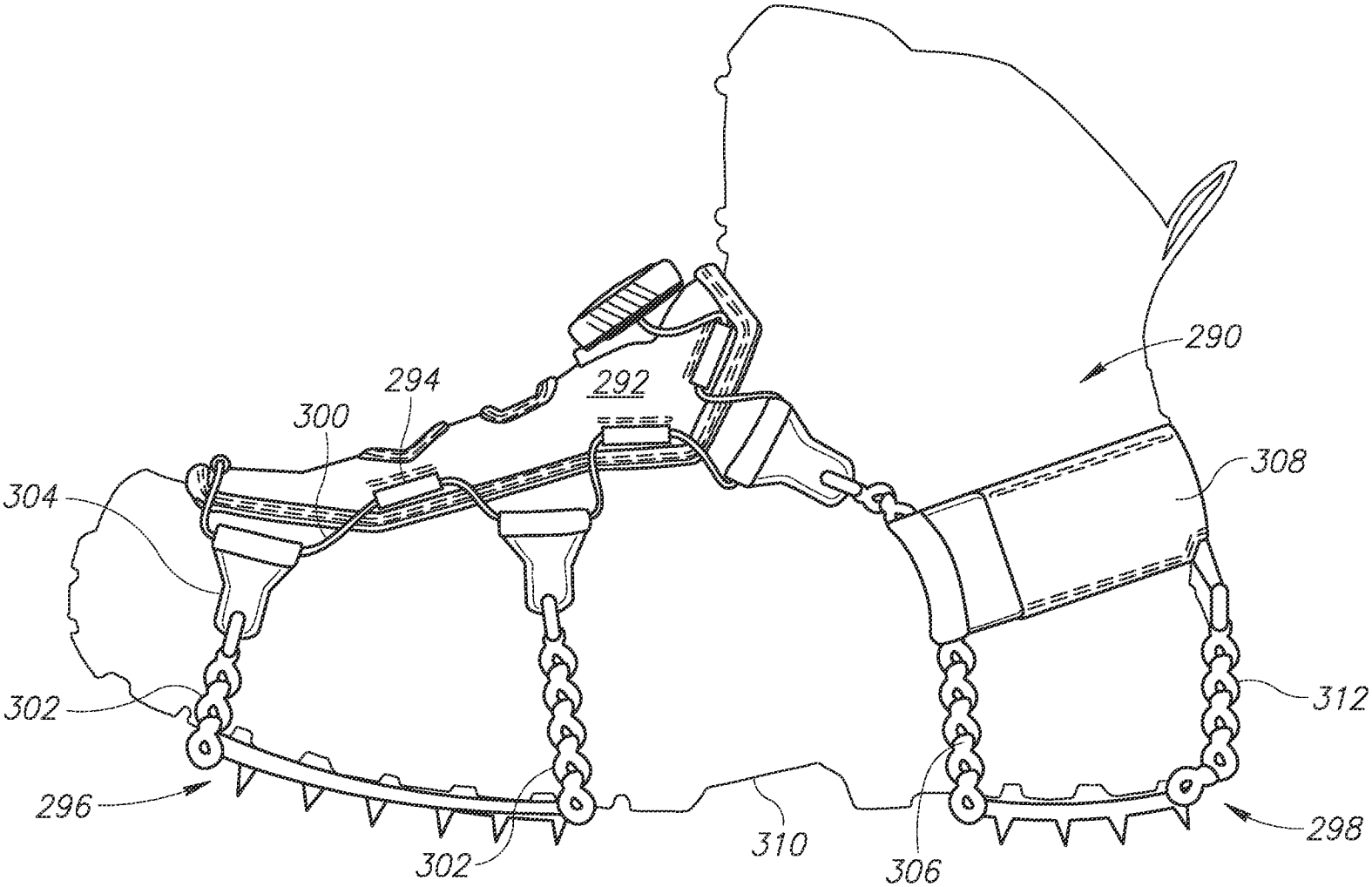
FIG. 7A illustrates a lateral side elevational view of the footwear traction device according to a seventh embodiment.
Figure 7B:
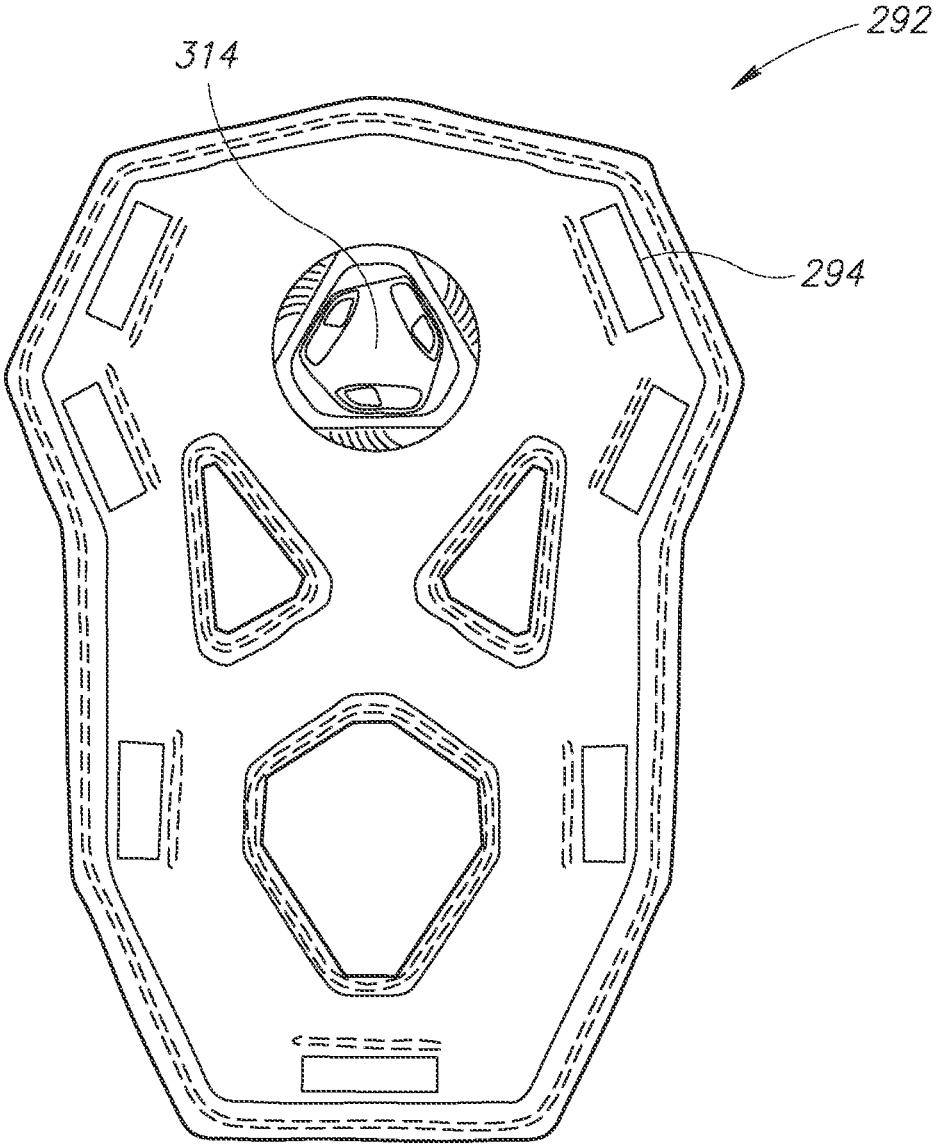
FIG. 7B illustrates a top plan view of an upper support portion of the footwear traction device of FIG. 7A.

A footwear traction device 290 according to a seventh embodiment is shown in FIGS. 7A and 7B. The footwear traction device 290 includes a flexibly bendable upper support member 292 provided with a plurality of upper member attachment portions 294, each having a cable guide or channel. The footwear traction device 290 further includes a forefoot traction section 296, and a separate heel traction section 298. A front portion of the upper support member 292 is attached to the forefoot traction section 296, and a rear portion of the upper support member is attached to the heel traction section 298. A cable 300 attaches the upper support member 292 to the forefoot traction section 296 and the heel traction section 298. The upper support member 292 has a thin elongated shape extending over the forefoot support section 296. The support member 292 is sized and shaped to cover an upper forefoot along the tongue of the footwear 12, and bend downwardly to at least partially cover medial and lateral sides of the upper forefoot of the footwear 12. One or more attachment portions 294 are positioned at a front end of the support member 292 and along each of the lateral and medial sides of the upper support member. The attachment portions 294 are positioned along or near an outer perimeter of the support member 292; however, the attachment portions may be positioned inward of the perimeter in some embodiments. Adjacent ones of the attachment portions 294 may be spaced apart from each other along the perimeter of the upper support member 292 at a distance sufficient to allow one or more attachment portion 304 to fit therebetween when the footwear traction device 290 is secured to the footwear 12.

One or more first supports 302 extend upwardly from the forefoot traction section 296 on the lateral and medial sides thereof toward the upper support member 292. The first supports 302 in the present embodiment are flexible structures such as cords, chains or cables that wrap around forefoot sides of the footwear 12 when attached to the footwear traction device 290; however, the first supports may be different flexible structures such as sidewalls, straps or comprise a frame-like structure that flexibly bends around the forefoot sides. The length of the first supports 302 may be fixed. The first supports 302 may bend or flex to adapt to the shape of the footwear 12 and allow the footwear traction device 290 to securely attach to a wide variety of footwear shapes and sizes. One or more attachment portions 304 are disposed on or at an upper end of the first supports 302, each attachment portion having a cable guide or channel for receiving and retaining a length of the cable 300.

One or more flexible second support or walls 306 extend upwardly from the lateral and medial sides of heel traction section 298. A flexible rear support 308 is positioned above a rear end of the heel traction section 298 and wraps around the rear end from the medial side to the lateral side thereof. One or more of the attachment portions 304 are disposed on or at an upper end of each of the second supports 306. One end portion of the rear support 308 may be attached by a fastener 310 to one end of the second supports 306 on the lateral side of the heel traction section 298 and the other end portion to one of the second supports on the medial side, at a location between the heel traction section 298 and the attachment portion 304. The position of the fasteners 310 along the length of the second supports 306 may be fixed. A portion of the second supports 306 above the rear support 308 may bend forwardly toward and have their attachment portions 304 attached to the upper support member 292.

A flexible third support 312 may extend upwardly from the rear end of the heel traction section 298 to a middle portion of the rear support 308 and have its upper end portion attached thereto. In some embodiments, the rear support 308, the second supports 306, the third supports 312 and/or the attachment portions 304 may comprise a frame-like structure sized and shaped to wrap at least partially around the heel portion 34 and rear medial and lateral sides of the footwear 12 when the footwear traction device 290 is attached thereto.

The cable 300 extends from a cable reel device 314 positioned on an upwardly facing surface the upper support member 292 and passes through the upper member attachment portions 294 and the attachment portions 304 of the first and second supports 302 and 306, attaching the forefoot traction section 296 and the heel traction section 298 to the upper support member 292. The cable 300 extends from the cable reel device 314, through the cable guide of the rearmost attachment portion 294 on the lateral side of the upper support member 292, and through the cable guide of the attachment portion 304 of one of the second supports 306 on the lateral side. The cable 300 then extends through the cable guide of the attachment portion 294 adjacent to the lateral side second supports 306, and then extends through the cable guide of the attachment portions 304 of the rearmost one of the first supports 302. The cable 300 then alternately passes through the attachment portions 304 of any other first supports 302 and attachment portions 294 of the upper support members 292 on the lateral side, then through the forward most attachment portion 294 on the upper support section and over to the medial side of the footwear traction device 290. On the medial side, the cable 300 extends rearwardly along a reverse path to the path described above with respect to the lateral side. One or more of the attachment portions 294 may be omitted from the upper support member 292 in some embodiments.

Rotation of the cable reel device 314 in the second rotational direction shortens the length of the cable 300 and pulls the attachment portions 304 upwardly toward the upper support member 292. As the length of the cable 300 is shortened, the attachment portions 304 are pulled toward gaps spacing peripherally adjacent ones of the attachment portions 294. The upper support member 292 is pulled downwardly and rearwardly against the upper surface of the footwear 12 installed in the footwear traction device 290, and the forefoot traction section 296 and the heel traction section 298 are pressed upwardly against the outer sole 17 of the footwear. As tension in the cable 300 increases, medial and lateral sides of the upper support member 292 bend downwardly against the upper side of the footwear 12 and tension in the supports 302, 306 and/or 312 increases until taut. Simultaneously, the second supports 306 pull the rear support 308 forwardly against the heel portion 34 of the footwear. The cable reel device 314 is operable as described above to release tension in the cable 300 and allow removal of the footwear 12 from the footwear traction device 290.

Figure 8A:
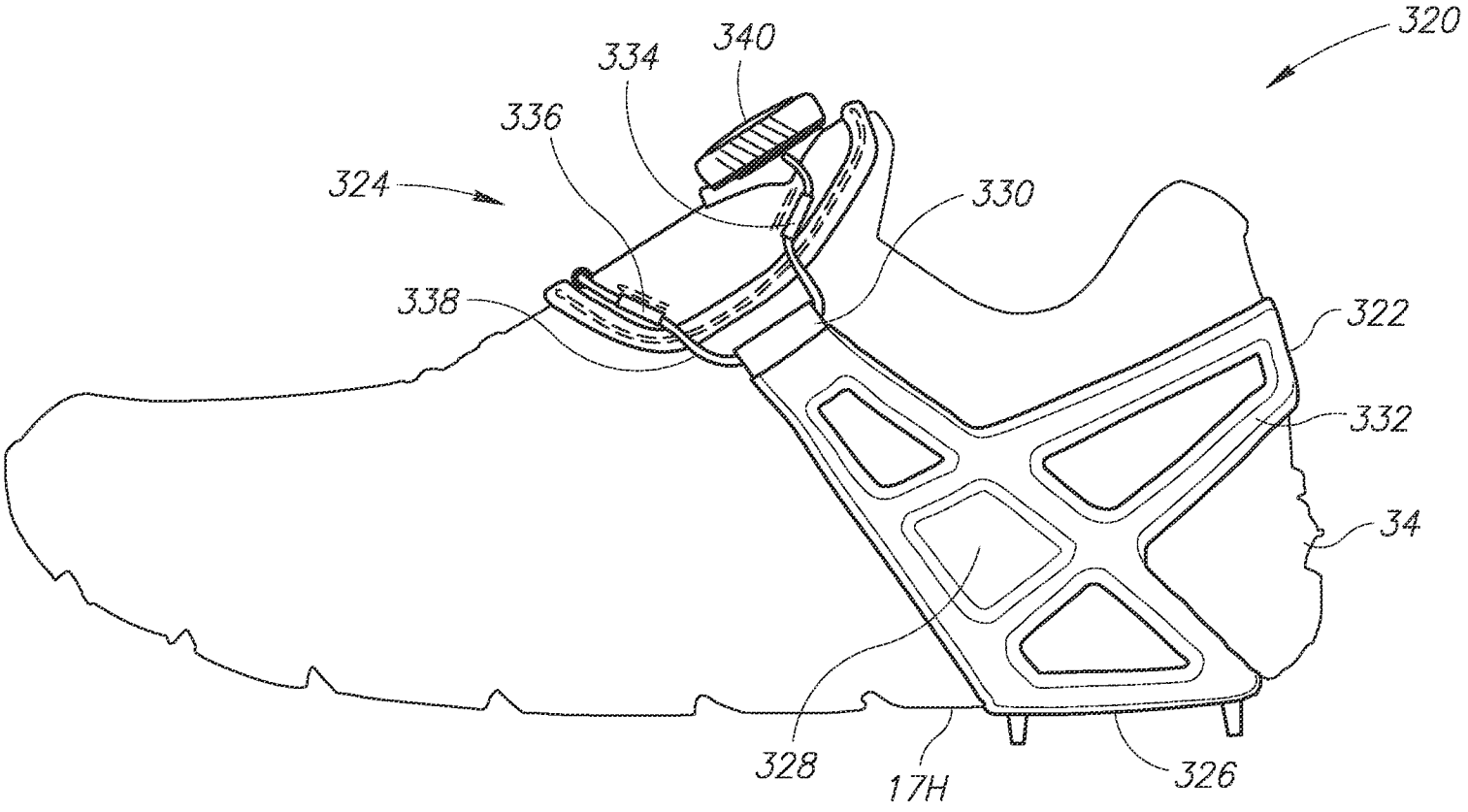
FIG. 8A illustrates a lateral side elevational view of the footwear traction device according to an eighth embodiment.
Figure 8B:
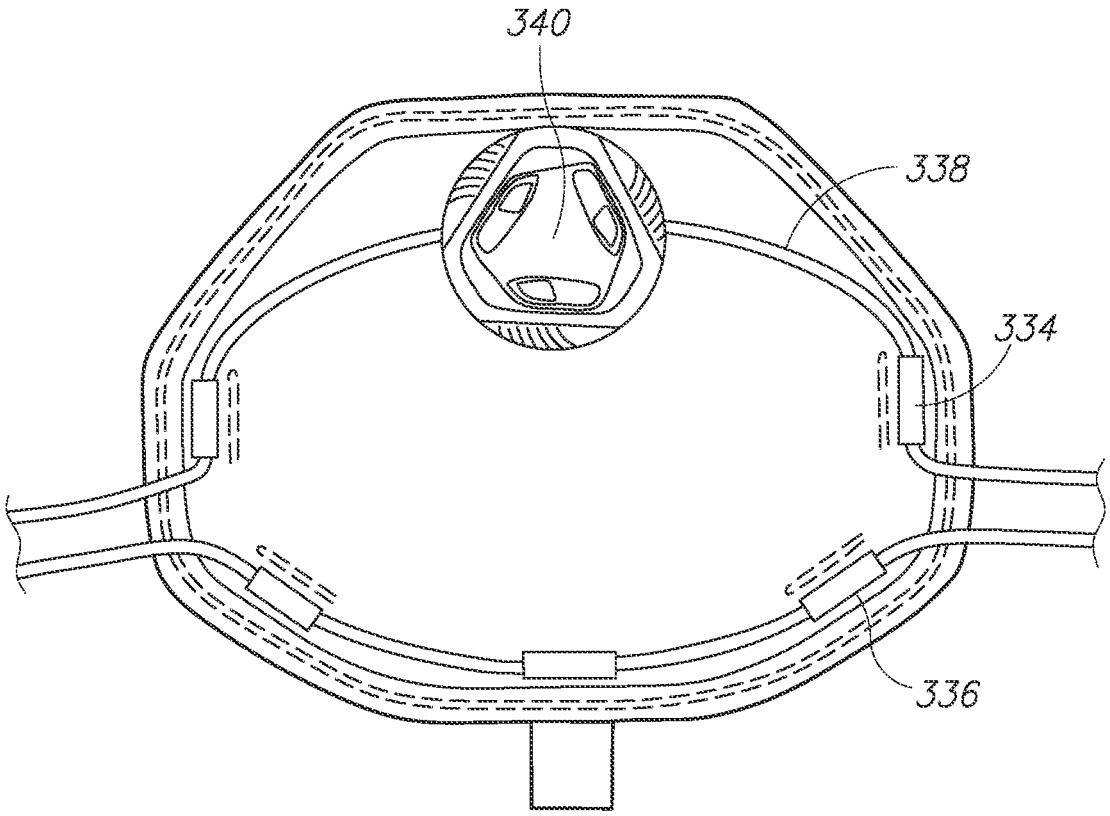
FIG. 8B illustrates a top plan view of an upper support section of the footwear traction device of FIG. 8A.

A footwear traction device 320 according to an eighth embodiment is shown in FIG. 8. The footwear traction device 320 has a heel traction section 322 having a traction portion 326 sized and shaped to underlie and at least partially cover a heel portion 17H of the outersole 17 of the footwear 12, and a flexible upper support member 324 adapted to flexibly press against an upper surface of the footwear opposite to the bottom heel and compressibly hold the footwear therebetween. The footwear traction device 320 may be selectively secured and unsecured to the footwear 12 using a cable reel device as described above. When the footwear traction device 320 is unsecured, the traction portion 326 may be moved upwardly and rearwardly from a use position (i.e., underlying the outer sole heel portion 17H) to a stowed position rearward of and covering the heel portion 34.

A support wall 328 extends upwardly and forwardly from each of the medial side and the lateral side of the traction portion 326. Each of the support walls 328 may extend upwardly at an inward angle with respect to the traction portion 326. An attachment portion 330 is disposed on or near an upper end of each of the support walls 328. A rear support 332 extends between and connects rear lateral and medial sides of the support walls 328 above a rear end of the traction portion 326.

The upper support member 324 has a flat shape extending laterally between the two support walls 328. Each of the lateral and the medial side of the upper support member 324 has a rear attachment portion 334 and a front attachment portion 336 spaced apart from and forward of the rear attachment portion of the upper support member. A cable 338 extends from a cable reel device 340 attached to the upper support member to the lateral side of the upper support member 324 and forwardly through the rear attachment portion 334 on the lateral side. The cable 338 then extends laterally to and through the lateral side attachment portion 330 of the lateral side support wall 328 of the heel traction section 322, then through the lateral side front attachment portion 336. The cable 338 then extends toward the medial side front attachment portion 336, then rearwardly and upwardly along the corresponding medial side attachment portions, and back into the cable reel device 340.

Rotation of the cable reel device 340 in one rotational direction is operable to shorten the length of the cable 338 as described above. When the footwear 12 is installed in the footwear traction device 320, shortening the length of the cable 338 pulls the rear support 332 forward against the heel portion 34, pulls the traction portion 326 forwardly and upwardly against the outer sole heel portion 17H, and mutually pulls the upper support member 324 downwardly against the upper surface of the footwear 12.

The cable reel device 340 is operable to release and unreel the cable 338, thereby unsecuring the footwear 12 to which the footwear traction device 320 is attached. When the footwear 12 is unsecured, the footwear may be removed from the footwear traction device 320 or the heel traction section 322 may be moved to a stowed position. When the heel traction section 322 is in the stowed position, an upper surface of the traction portion 326 is positioned against the rearwardly facing surface of the heel portion 34 above a rear end of the outer sole heel portion 17H. The rear support 332 is positioned against the rearwardly facing surface of the heel portion 34 above the traction portion 326. The cable reel device 340 may then be rotated in the one direction to shorten length of the cable 338 and secure the traction portion 326 and the rear support 332 against the back of the heel portion 34.

The medial side of the footwear traction devices described herein may be substantially similar to the lateral side except where otherwise illustrated or described, so further illustration or description thereof is omitted for brevity.

The footwear traction devices described above provide a more secure fit to footwear than previously-implemented designs. Moreover, the footwear traction devices fit a wider variety of shapes and sizes of footwear. The cables connecting the support portions are protected by cable guides and/or frames to prevent the cable from snagging, cutting, or ablating.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations.

However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or"at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Accordingly, the invention is not limited except as by the appended claims.

What is claimed is:

1. A footwear traction device removably attachable to an item of footwear having a bottom outersole, a rear portion, and a forward portion:

a traction portion sized and shaped to at least partially cover the bottom outersole of the item of footwear, and having a rear portion, a forward portion, the traction portion having one or more traction elements disposed on a bottom of the traction portion for increasing friction between the item of footwear and a ground surface;

a heel support portion attached to and extending upwardly from the rear portion of the traction portion and having opposing first attachment points disposed on a forward portion of lateral and medial sides of the heel support portion, each attachment point having a heel-support cable guide;

a forefoot support portion attached to the forward portion of the traction portion the forefoot support portion having a pair of lateral and medial supports extending upwardly from the lateral and medial sides of the traction portion for wrapping around the lateral and medial front sides of the item of footwear, the lateral and medial supports each having a lateral support attachment portion having a cable guide;

a cable reel device;

a cable; and a flexible upper support portion having an elongate shape and configured to cover an upper forefoot portion of the item of footwear, including over a tongue or lace area and extending between the medial side and the lateral side of the footwear traction device, and having one or more attachment portions each having an upper-support cable guide, the upper support portion being a discrete structure separated from and not directly coupled to the heel support portion;

a cable routing wherein the cable forms a tensionable loop routing through the cable reel device, and each cable guide; and wherein the forefoot support portion and/or the heel support portion and the cable routing are configured to define an opening through which respectively the forward and/or rear portions of the item of footwear protrude when the cable is so tensioned, the cable routing being configured to converge the forefoot support portion and the heel support portion towards each so as to urge the forward and/or rear portions of the item of footwear more tightly through the opening and against the forefoot and/or heel support portions of the item of footwear, and wherein the upper support portion is simultaneously urged towards the traction portion.

2. The footwear traction device of claim 1 for use where the item of footwear has a back, wherein the cable reel device is rotatable between a first rotational position at which the length of the cable is a first length allowing the item of footwear to be inserted into or removed from the footwear traction device, and a second rotational position at which the length of the cable is a second length shorter than the first length, the second length snugly positioning the rear support against the back of the item of footwear and snugly positioning the forward support against the forefoot of the item of footwear to secure the footwear traction device to the item of footwear.

3. The footwear traction device of claim 1, wherein the cable reel device is rotatably operable to draw the rear support and the forward support peripherally inward as the length of the cable is shortened to secure the footwear traction device to the item of footwear.

4. The footwear traction device of claim 1, wherein at least one of the first cable guides of the heel support portion extends through the rear support from the lateral side to the medial side.

5. A footwear traction device removably attachable to an item of footwear, the footwear traction device comprising:

a traction portion sized and shaped to at least partially cover the bottom outersole of the item of footwear, and having one or more traction elements disposed on a bottom surface of the traction portion for increasing friction between the item of footwear and an icy ground surface;

a forefoot support portion comprising at least one pair of side support portions extending upwardly from each of a medial side and a lateral side of a forward portion of the traction portion, each side support portion including a forward attachment portion having a forward cable guide;

an upper support portion having a flexible upper support body extending between the medial side and the lateral side of the footwear traction device and at least an upper attachment portion having an upper cable guide;

a heel support portion positioned at a rear portion of the traction portion for attaching at or around the heel of the item of footwear, the heel support portion having a rear support that extends along and at least partially covers a rearwardly facing heel portion of the item of footwear, the heel support portion having lateral and medial extending sidewalls upwardly from the traction portion, and each including a rear attachment portion with at least one rear cable guide;

wherein the upper support portion is a discrete structure separated from and not directly coupled to the heel support portion, the upper-support portion comprising a flexible member having a lower portion attached to and part of the front support;

a cable reel device;

a cable extending from the cable reel device and through cable guides and back to the cable device;

a cable routing wherein the cable can simultaneously and tensionably interconnect the traction portion, the forefoot portion, the upper support portion, and the heel support on rotation of the cable reel device; and wherein (1) the traction portion, and (2) the heel support portion and/or forefoot support each comprise an elastic body of material that resiliently stretches against the item of footwear as the cable tension is increased.

6. The footwear traction device of claim 5, further comprising a rear support extending rearwardly from a back side of each of side support sections, the rear support being positionable to cover a back of the heel of the item of footwear when the heel traction portion is covering the bottom outersole heel of the item of footwear, and wherein when unsecured, the heel traction portion and rear support are upwardly movable from the bottom outersole heel to a stowed position against the rearwardly facing surface of the back of the item of footwear above the bottom outersole heel, and the cable reel device is rotatably operable to shorten the length of the cable to snugly position the upper surface of the heel traction portion against the back of the item of footwear.

7. The footwear traction device of claim 5, wherein when the cable reel device is rotationally operated to shorten the length of the cable, the forward attachment portions and upper attachment portions are pulled mutually toward each other compressing the item of footwear between the traction portion and upper support section towards one another.

8. The footwear traction device of claim 5, wherein the cable reel device is rotatable between a first rotational position at which the length of the cable is a first length allowing the item of footwear to be inserted into or removed from the footwear traction device, and a second rotational position at which the length of the cable is a second length shorter than the first length, the second length snugly pulling the traction portion upwardly against the bottom outersole heel and snugly pulling the upper support portion downwardly against a forefoot of the item of footwear thereby securely attaching the footwear traction device to the item of footwear.

9. The footwear traction device of claim 8, wherein, the heel traction portion is upwardly movable to the stowed position when the upper support body is positioned above an upper forefoot portion of the item of footwear, an upper surface of the heel traction portion is positioned below the bottom outersole heel of the item of footwear, and the cable reel device is at the first rotational position.

10. The footwear traction device of claim 1 wherein the forefoot support portion and cable routing are configured to allow the forward portion of the item of footwear to protrude.

11. The footwear traction device of claim 1 wherein the heel support portion and cable routing are configured to allow the rear portion of the item of footwear to protrude.

12. The footwear traction device of claim 1 wherein the forefoot support portion and cable routing are configured to define an opening through which the forward portion of the item of footwear can protrude, and the heel support portion is configured to define an opening through which the rear portion of the item of footwear can protrude.

13. The footwear traction device of claim 5 wherein the forefoot support portion and cable routing are configured to define an opening through which the forward portion of the item of footwear can protrude from the front of the traction device, the cable routing being configured to converge the forefoot support portion and the rearfoot portion towards each other so as to urge the forward portion of the item of footwear more tightly through the opening and against the forefoot support portion of the item of footwear.

14. The footwear traction device of claim 5 wherein the heel support portion and cable routing are configured to define an opening through which the rear portion of the item of footwear can protrude from the rear of the traction device, the cable routing being configured to converge the forefoot support portion and the heel support portion towards each other so as to urge the rear portion of the item of footwear more tightly through the opening and against the heel support portion of the item of footwear.

15. The footwear traction device of claim 5 wherein the forefoot support portion and cable routing are configured to define an opening that exposes the forward portion of the item of footwear from the front of the traction device and the heel support portion and cable routing are configured to define an opening that exposes the rear portion of the item of footwear from the rear of the traction device, the cable routing being configured to converge the forefoot support portion and the heel support portion towards each other so as to urge the forward portion of the item of footwear more tightly through the opening and against the forefoot support portion and to urge the rear portion of the item of footwear more tightly through the opening and against the heel support portion of the item of footwear.

16. The footwear traction device of claim 1 wherein (1) the traction portion, and (2) the heel support portion and/or the forefoot support portion each comprise an elastic material that stretches against the item of footwear as the cable tension is increased.

* * * * *